US009605218B2

(12) United States Patent
Smiley et al.

(10) Patent No.: US 9,605,218 B2
(45) Date of Patent: Mar. 28, 2017

(54) INTEGRATED HYDROCRACKING AND SLURRY HYDROCONVERSION OF HEAVY OILS

(71) Applicants: Randolph J. Smiley, Hellertown, PA (US); Ajit Bhaskar Dandekar, Falls Church, VA (US); Ramanathan Sundararaman, Frederick, MD (US); Rustom Merwan Billimoria, Hellertown, PA (US); Thomas Francis Degnan, Jr., Philadelphia, PA (US)

(72) Inventors: Randolph J. Smiley, Hellertown, PA (US); Ajit Bhaskar Dandekar, Falls Church, VA (US); Ramanathan Sundararaman, Frederick, MD (US); Rustom Merwan Billimoria, Hellertown, PA (US); Thomas Francis Degnan, Jr., Philadelphia, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 335 days.

(21) Appl. No.: 14/308,893

(22) Filed: Jun. 19, 2014

(65) Prior Publication Data

US 2015/0014217 A1 Jan. 15, 2015

Related U.S. Application Data

(60) Provisional application No. 61/837,353, filed on Jun. 20, 2013.

(51) Int. Cl.

| | |
|---|---|
| ***C10G 65/12*** | (2006.01) |
| ***C10G 45/16*** | (2006.01) |
| ***C10G 47/26*** | (2006.01) |
| ***C10G 49/12*** | (2006.01) |

(52) U.S. Cl.

CPC ..... *C10G 65/12* (2013.01); *C10G 45/16* (2013.01); *C10G 47/26* (2013.01); *C10G 49/12* (2013.01)

(58) Field of Classification Search

CPC ..... C10G 65/12

See application file for complete search history.

(56) References Cited

U.S. PATENT DOCUMENTS

| | | | | |
|---|---|---|---|---|
| 4,762,607 | A | 8/1988 | Aldridge et al. | |
| 5,300,213 | A * | 4/1994 | Bartilucci | C10G 67/0445 208/18 |
| 5,755,955 | A | 5/1998 | Benham et al. | |
| 2010/0122939 | A1 | 5/2010 | Bauer et al. | |
| 2011/0210045 | A1 | 9/2011 | Kou et al. | |
| 2011/0315599 | A1 * | 12/2011 | Prentice | C10G 45/06 208/66 |
| 2012/0004478 | A1 * | 1/2012 | Umansky | B01D 3/141 585/240 |
| 2013/0075303 | A1 | 3/2013 | Heraud et al. | |
| 2013/0112593 | A1 | 5/2013 | Montanari et al. | |

OTHER PUBLICATIONS

PCT Application No. PCT/US2014/043124, Communication from the International Searching Authority, Form PCT/ISA/220, dated Sep. 22, 2014, 9 pages.

* cited by examiner

*Primary Examiner* — Randy Boyer

(74) *Attorney, Agent, or Firm* — Chad A. Guice; David M. Weisberg; Jamie L. Sullivan

(57) ABSTRACT

Improved yields of fuels and/or lubricants from a resid or other heavy oil feed can be achieved using slurry hydroconversion to convert at least about 90 wt % of the feed. The converted portion of the feed can then be passed into one or more hydroprocessing stages. An initial processing stage can be a hydrotreatment stage for additional removal of contaminants and for passivation of high activity functional groups that may be created during slurry hydroconversion. The hydrotreatment effluent can then be fractionated to separate naphtha boiling range fractions from distillate fuel boiling range fractions and lubricant boiling range fractions. At least the lubricant boiling range fraction can then be hydrocracked to improve the viscosity properties. The hydrocracking effluent can also be dewaxed to improve the cold flow properties. The hydrocracked and/or dewaxed product can then be optionally hydrofinished.

15 Claims, 7 Drawing Sheets

INTEGRATED HYDROCRACKING AND SLURRY HYDROCONVERSION OF HEAVY OILS

CROSS-REFERENCE TO RELATED APPLICATIONS

This application claims the benefit of priority from U.S. Provisional Application 61/837,353, filed on Jun. 20, 2013, titled "Integrated Hydrocracking and Slurry Hydroconversion of Heavy Oils", the entirety of which is incorporated herein by reference.

FIELD OF THE INVENTION

This invention provides methods for processing of resids and other heavy oil feeds or refinery streams.

BACKGROUND OF THE INVENTION

Slurry hydroconversion provides a method for conversion of high boiling, low value petroleum fractions into higher value liquid products. Slurry hydroconversion technology can process difficult feeds, such as feeds with high Conradson carbon residue (CCR) while still maintaining high liquid yields. In addition to resid feeds, slurry hydroconversion units have been demonstrated to process other challenging streams present in refinery/petrochemical complexes such as deasphalted rock, steam cracked tar, and visbreaker tar. Unfortunately, slurry hydroconversion is also an expensive refinery process from both a capital investment standpoint and a hydrogen consumption standpoint.

Various slurry hydroconversion configurations have previously been described. For example, U.S. Pat. No. 5,755,955 and U.S. Patent Application Publication 2010/0122939 provide examples of configurations for performing slurry hydroconversion. U.S. Patent Application Publication 2011/0210045 also describes examples of configurations for slurry hydroconversion, including examples of configurations where the heavy oil feed is diluted with a stream having a lower boiling point range, such as a vacuum gas oil stream and/or catalytic cracking slurry oil stream, and examples of configurations where a bottoms portion of the product from slurry hydroconversion is recycled to the slurry hydroconversion reactor.

U.S. Patent Application Publication 2013/00575303 describes a reaction system for combining slurry hydroconversion with a coking process. An unconverted portion of the feed after slurry hydroconversion is passed into a coker for further processing. The resulting coke is described as being high in metals. This coke can be combusted to allow for recovery of the metals. The recovered metals are described as being suitable for forming a catalytic solution for use as a catalyst in the slurry hydroconversion process.

U.S. Patent Application Publication 2013/0112593 describes a reaction system for performing slurry hydroconversion on a deasphalted heavy oil feed. The asphalt from deasphalting and a portion of the unconverted material from the slurry hydroconversion can be gasified to form hydrogen and carbon oxides.

SUMMARY OF THE INVENTION

In an aspect, a method for processing a heavy oil feedstock is provided. The method includes providing a heavy oil feedstock having an initial boiling point of at least about 650° F. (343° C.) and a first Conradson carbon residue wt %;

exposing the heavy oil feedstock to a catalyst under effective slurry hydroconversion conditions to form at least a first liquid product, the effective slurry hydroconversion conditions being effective for conversion of at least about 90 wt % of the heavy oil feedstock relative to a conversion temperature; hydrotreating the first liquid product under effective hydrotreating conditions to form a first hydrotreated liquid product; fractionating the first hydrotreated liquid product to form one or more naphtha boiling range products, one or more distillate fuel boiling range products, and one or more lubricating base oil boiling range products; and hydrocracking at least a portion of the one or more lubricating base oil boiling range products to form at least one hydrocracked fuel product and a hydrocracking bottoms product.

In another aspect, a method is provided for processing a heavy oil feedstock. The method includes separating a feedstock to form at least a bottoms fraction having a 10% distillation temperature of at least 900° F. (482° C.) and a first plurality of liquid products having a lower boiling range that the bottoms fraction; hydrotreating the first plurality of liquid products under effective hydrotreating conditions to form a first plurality of hydrotreated effluents; fractionating the hydrotreated effluent to form a first plurality of liquid products, the first plurality of liquid fraction including a first lubricant boiling range fraction; hydrocracking at least a portion of the first lubricant base oil boiling range fraction under effective hydrocracking conditions; exposing at least a portion of the bottoms fraction to a catalyst under effective slurry hydroconversion conditions to form at least a second plurality of liquid product including at least a second lubricant boiling range fraction, the effective slurry hydroconversion conditions being effective for conversion of at least about 90 wt % of the bottoms fraction relative to a conversion temperature; and hydrocracking at least a portion of the second lubricant base oil boiling range fraction.

DETAILED DESCRIPTION OF THE EMBODIMENTS

Overview

Figure 1:
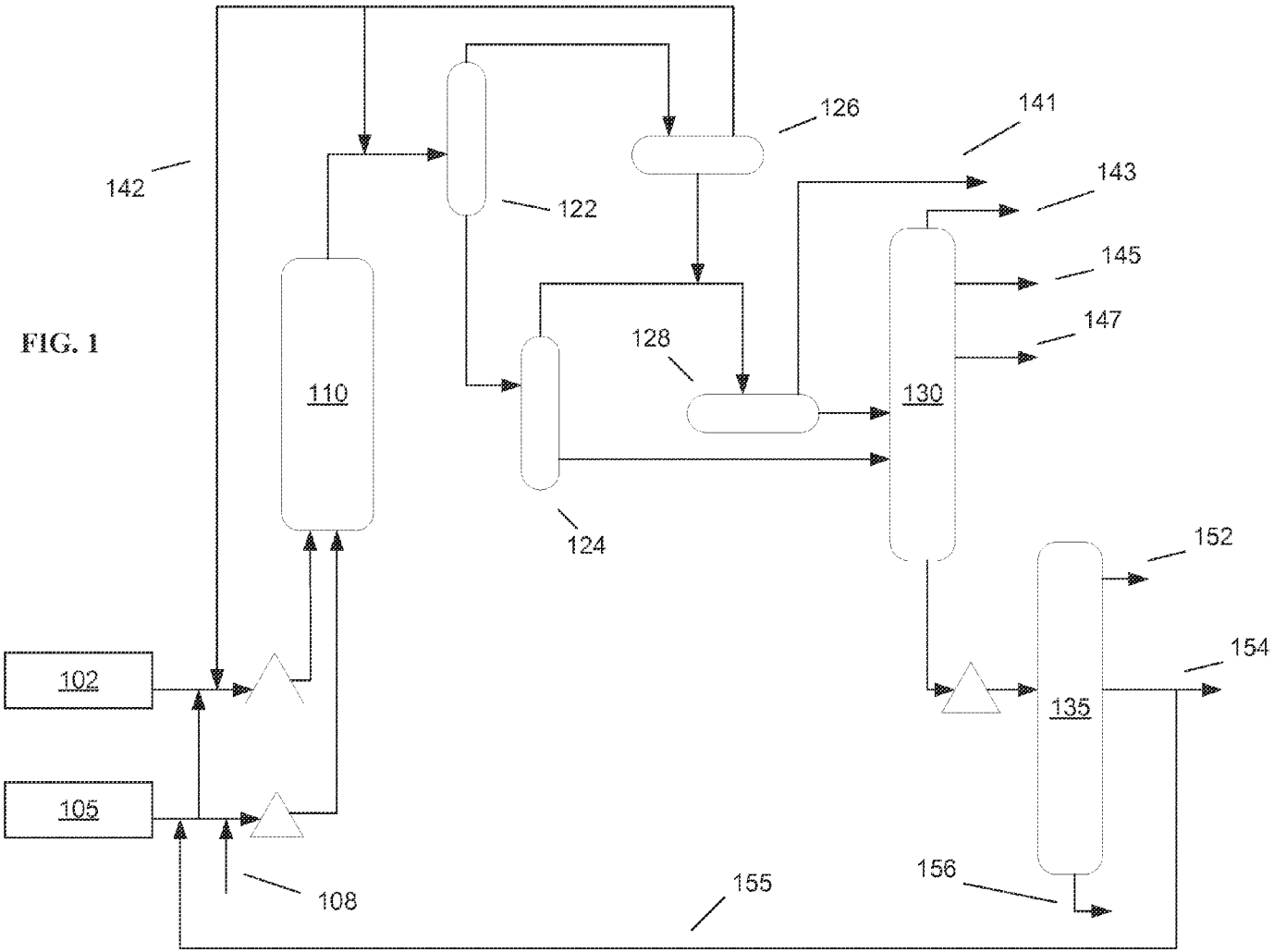
FIG. 1 shows an example of a slurry hydroconversion reaction system.

In various aspects, systems and methods are provided for integration of slurry hydroconversion with fixed bed hydroprocessing in order to produce distillate fuels and/or lubricants. One of the difficulties in formation of lubricant products is that the yield is limited based on the amount of components in a crude slate that have an appropriate initial boiling range. Using slurry hydroconversion to perform conversion on a vacuum resid or other heavy oil feed provides a method for increasing the amount of feedstock that remains in the lubricant boiling range after removal of contaminants and/or improvement of the cold flow properties of the products.

When treating a feed that includes components with a boiling point of at least about 950° F. (510° C.), such as at least about 1050° F. (566° C.), the feed can be fractionated prior to hydroprocessing to form a resid or bottoms fraction containing the higher boiling components. The resid portion can be more difficult to hydrotreat, requiring higher severity conditions to remove sulfur to a desired level for fuels hydrocracking or lubes hydrocracking. Separating out the resid portion can prevent overprocessing of the distillate and gas oil portions of the feed. Conventionally, this resid portion is then used to form fuel oil, asphalt, and/or other petroleum streams with a reduced value.

In some aspects, the resid fraction of a feedstock (or another type of heavy oil feed) can be exposed to slurry hydroconversion conditions in order to convert at least a portion of the resid fraction into naphtha, distillate, and/or gas oil boiling range components. The resid fraction can represent a resid of a feed that was fractionated prior to performing hydroprocessing on the remainder of the feed. Alternatively, the resid or heavy oil can represent a whole or partial crude for processing under slurry hydroconversion conditions. As still another option, a feed can be initially fractionated to separate a resid fraction from a distillate and/or gas oil portion of the feed. The resid fraction can be exposed to slurry hydroconversion conditions to form additional distillate and gas oil. The additional distillate and gas oil formed during slurry hydroconversion can then be added, after optional hydrotreatment, to the distillate and/or gas oil portion generated in the initial fractionation. This can allow for increased fuels and/or lubricants yield from an initial whole or partial crude feedstock.

In some aspects, improved yields of fuels and/or lubricants from a resid or other heavy oil feed can be achieved using slurry hydroconversion to convert at least about 90 wt % of the feed. The converted portion of the feed can then be passed into one or more hydroprocessing stages. An initial processing stage can be a hydrotreatment stage for additional removal of contaminants and for passivation of high activity functional groups that may be created during slurry hydroconversion. The hydrotreatment effluent can then be fractionated to separate naphtha boiling range fractions from distillate fuel boiling range fractions and lubricant boiling range fractions. At least the lubricant boiling range fraction can then be hydrocracked to improve the viscosity properties. The hydrocracking effluent can also be dewaxed to improve the cold flow properties. The hydrocracked and/or dewaxed product can then be optionally hydrofinished. The hydrocracking and/or dewaxing stages can include molecular sieve catalysts for performing the hydrocracking and/or dewaxing. Suitable catalysts can include, for example, one or more catalysts selected from USY and ZSM-48 catalysts. The catalysts can optionally (but preferably) include one or more hydrogenation metals, such as noble Group VIII metals or non-noble Group VIII and Group VIB metals. Using this type of configuration allows the fixed bed hydrocracking stage to be operated under sweet conditions, as the sulfur and nitrogen-containing contaminants can be removed using the slurry hydroconversion and the subsequent hydrotreatment stage. The catalysts can also optionally include a binder.

Feedstocks

In some aspects, a wide range of petroleum and chemical feedstocks can be hydroprocessed and/or slurry hydroprocessed in accordance with the invention. Suitable feedstocks include whole and reduced petroleum crudes, atmospheric and vacuum residua, propane deasphalted residua, e.g., brightstock, cycle oils, FCC tower bottoms, gas oils, including vacuum gas oils and coker gas oils, light to heavy distillates including raw virgin distillates, hydrocrackates, hydrotreated oils, slack waxes, Fischer-Tropsch waxes, raffinates, and mixtures of these materials.

One way of defining a feedstock is based on the boiling range of the feed. One option for defining a boiling range is to use an initial boiling point for a feed and/or a final boiling point for a feed. Another option, which in some instances may provide a more representative description of a feed, is to characterize a feed based on the amount of the feed that boils at one or more temperatures. For example, a "T5" boiling point for a feed is defined as the temperature at which 5 wt % of the feed will boil off. Similarly, a "T95" boiling point is a temperature at 95 wt % of the feed will boil.

Typical feeds for production of lubricant basestocks include, for example, feeds with an initial boiling point of at least about 650° F. (343° C.), or at least about 700° F. (371° C.), or at least about 750° F. (399° C.). Alternatively, a feed may be characterized using a T5 boiling point, such as a feed with a T5 boiling point of at least about 650° F. (343° C.), or at least about 700° F. (371° C.), or at least about 750° F. (399° C.). In some aspects, the final boiling point of the feed can be at least about 1100° F. (593° C.), such as at least about 1150° F. (621° C.) or at least about 1200° F. (649° C.). In other aspects, a feed may be used that does not include a large portion of molecules that would traditional be considered as vacuum distillation bottoms. For example, the feed may correspond to a vacuum gas oil feed that has already been separated from a traditional vacuum bottoms portion. Such feeds include, for example, feeds with a final boiling point of about 1150° F. (62° C.), or about 1100° F. (593° C.) or less, or about 1050° F. (566° C.) or less. Alternatively, a feed may be characterized using a T95 boiling point, such as a feed with a T95 boiling point of about 1150° F. (621° C.) or less, or about 1100° F. (593° C.) or less, or about 1050° F. (566° C.) or less. An example of a suitable type of feedstock is a wide cut vacuum gas oil (VGO) feed, with a T5 boiling point of at least about 700° F. (371° C.) and a T95 boiling point of about 1100° F. or less. Optionally, the initial boiling point of such a wide cut VGO feed can be at least about 700° F. and/or the final boiling point can be at least about 1100° F. It is noted that feeds with still lower initial boiling points and/or T5 boiling points may also be suitable, so long as sufficient higher boiling material is available so that the overall nature of the process is a lubricant base oil production process and/or a fuels hydrocracking process.

The above feed description corresponds to a potential feed for producing lubricant base oils. In some aspects, methods are provided for producing both fuels and lubricants. Because fuels are a desired product, feedstocks with lower boiling components may also be suitable. For example, a feedstock suitable for fuels production, such as a light cycle oil, can have a T5 boiling point of at least about 350° F. (177° C.), such as at least about 400° F. (204° C.). Examples of a suitable boiling range include a boiling range of from about 350° F. (177° C.) to about 700° F. (371° C.), such as from about 390° F. (200° C.) to about 650° F. (343° C.). Thus, a portion of the feed used for fuels and lubricant base oil production can include components having a boiling range from about 170° C. to about 350° C. Such components can be part of an initial feed, or a first feed with a T5 boiling point of about 650° F. (343° C.) can be combined with a second feed, such as a light cycle oil, that includes components that boil between 200° C. and 350° C.

In embodiments involving an initial sulfur removal stage prior to hydrocracking, the sulfur content of the feed can be at least 300 ppm by weight of sulfur, or at least 1000 wppm, or at least 2000 wppm, or at least 4000 wppm, or at least 10,000 wppm, or at least about 20,000 wppm. In other embodiments, including some embodiments where a previously hydrotreated and/or hydrocracked feed is used, the sulfur content can be about 2000 wppm or less, or about 1000 wppm or less, or about 500 wppm or less, or about 100 wppm or less.

In some aspects, a slurry hydroprocessed product and/or intermediate products can also be produced from a heavy oil feed component. Examples of heavy oils include, but are not limited to, heavy crude oils, distillation residues, heavy oils coming from catalytic treatment (such as heavy cycle bottom slurry oils from fluid catalytic cracking), thermal tars (such as oils from visbreaking, steam cracking, or similar thermal or non-catalytic processes), oils (such as bitumen) from oil sands and heavy oils derived from coal.

Heavy oil feedstocks can be liquid or semi-solid. Examples of heavy oils that can be hydroprocessed, treated or upgraded according to this invention include bitumens and residuum from refinery distillation processes, including atmospheric and vacuum distillation processes. Such heavy oils can have an initial boiling point of 650° F. (343° C.) or greater. Preferably, the heavy oils will have a 10% distillation point of at least 650° F. (343° C.), alternatively at least 660° F. (349° C.) or at least 750° F. (399° C.). In some aspects the 10% distillation point can be still greater, such as at least 900° F. (482° C.), or at least 950° F. (510° C.), or at least 975° F. (524° C.), or at least 1020° F. (549° C.) or at least 1050° F. (566° C.). In this discussion, boiling points can be determined by a convenient method, such as ASTM D86, ASTM D2887, or another suitable standard method.

In addition to initial boiling points and/or 10% distillation points, other distillation points may also be useful in characterizing a feedstock. For example, a feedstock can be characterized based on the portion of the feedstock that boils above 1050° F. (566° C.). In some aspects, a feedstock can have a 70% distillation point of 1050° F. or greater, or a 60% distillation point of 1050° F. or greater, or a 50% distillation point of 1050° F. or greater, or a 40% distillation point of 1050° F. or greater.

Density, or weight per volume, of the heavy hydrocarbon can be determined according to ASTM D287-92 (2006) Standard Test Method for API Gravity of Crude Petroleum and Petroleum Products (Hydrometer Method), and is provided in terms of API gravity. In general, the higher the API gravity, the less dense the oil. API gravity is 20° or less in one aspect, 15° or less in another aspect, and 10° or less in another aspect.

Heavy oils can be high in metals. For example, the heavy oil can be high in total nickel, vanadium and iron contents. In one embodiment, the heavy oil will contain at least 0.00005 grams of Ni/V/Fe (50 ppm) or at least 0.0002 grams of Ni/V/Fe (200 ppm) per gram of heavy oil, on a total elemental basis of nickel, vanadium and iron.

Contaminants such as nitrogen and sulfur are typically found in heavy oils, often in organically-bound form. Nitrogen content can range from about 50 wppm to about 10,000 wppm elemental nitrogen or more, based on total weight of the heavy hydrocarbon component. The nitrogen containing compounds can be present as basic or non-basic nitrogen species. Examples of basic nitrogen species include quinolines and substituted quinolines. Examples of non-basic nitrogen species include carbazoles and substituted carbazoles.

Slurry hydroconversion can be used for treating heavy oils containing at least 500 wppm elemental sulfur, based on total weight of the heavy oil. Generally, the sulfur content of such heavy oils can range from about 500 wppm to about 100,000 wppm elemental sulfur, or from about 1000 wppm to about 50,000 wppm, or from about 1000 wppm to about 30,000 wppm, based on total weight of the heavy component. Sulfur will usually be present as organically bound sulfur. Examples of such sulfur compounds include the class of heterocyclic sulfur compounds such as thiophenes, tetrahydrothiophenes, benzothiophenes and their higher homologs and analogs. Other organically bound sulfur compounds include aliphatic, naphthenic, and aromatic mercaptans, sulfides, and di- and polysulfides.

Heavy oils can be high in n-pentane asphaltenes. In some aspects, the heavy oil can contain at least about 5 wt % of n-pentane asphaltenes, such as at least about 10 wt % or at least 15 wt % n-pentane asphaltenes.

Still another method for characterizing a heavy oil feedstock is based on the Conradson carbon residue of the feedstock. The Conradson carbon residue of the feedstock can be at least about 5 wt %, such as at least about 10 wt % or at least about 20 wt %. Additionally or alternately, the Conradson carbon residue of the feedstock can be about 50 wt % or less, such as about 40 wt % or less or about 30 wt % or less.

In various aspects of the invention, reference may be made to one or more types of fractions generated during distillation of a petroleum feedstock. Such fractions may include naphtha fractions, kerosene fractions, diesel fractions, and vacuum gas oil fractions. Each of these types of fractions can be defined based on a boiling range, such as a boiling range that includes at least 90 wt % of the fraction, and preferably at least 95 wt % of the fraction. For example, for many types of naphtha fractions, at least 90 wt % of the fraction, and preferably at least 95 wt %, can have a boiling point in the range of 85° F. (29° C.) to 350° F. (177° C.). For some heavier naphtha fractions, at least 90 wt % of the fraction, and preferably at least 95 wt %, can have a boiling point in the range of 85° F. (29° C.) to 400° F. (204° C.). For a kerosene fraction, at least 90 wt % of the fraction, and preferably at least 95 wt %, can have a boiling point in the range of 300° F. (149° C.) to 600° F. (288° C.). Alternatively, for a kerosene fraction targeted for some uses, such as jet fuel production, at least 90 wt % of the fraction, and preferably at least 95 wt %, can have a boiling point in the range of 300° F. (149° C.) to 550° F. (288° C.). For a diesel fraction, at least 90 wt % of the fraction, and preferably at least 95 wt %, can have a boiling point in the range of 400° F. (204° C.) to 750° F. (399° C.).

Slurry Hydroconversion

FIG. 1 shows an example of a reaction system suitable for performing slurry hydroconversion. The configuration in FIG. 1 is provided as an aid in understanding the general features of a slurry hydroconversion process. It should be understood that, unless otherwise specified, the conditions described in association with FIG. 1 can generally be applied to any convenient slurry hydroconversion configuration.

In FIG. 1, a heavy oil feedstock 105 is mixed with a catalyst 108 prior to entering one or more slurry hydroconversion reactors 110. The mixture of feedstock 105 and catalyst 108 can be heated prior to entering reactor 110 in order to achieve a desired temperature for the slurry hydroconversion reaction. A hydrogen stream 102 is also fed into reactor 110. Optionally, a portion of feedstock 105 can be mixed with hydrogen stream 102 prior to hydrogen stream 102 entering reactor 110. Optionally, feedstock 105 can also include a portion of recycled vacuum gas oil 155. Optionally, hydrogen stream 102 can also include a portion of recycled hydrogen 142.

The effluent from slurry hydroconversion reactor(s) 110 is passed into one or more separation stages. For example, an initial separation stage can be a high pressure, high temperature (HPHT) separator 122. A higher boiling portion from the HPHT separator 122 can be passed to a low pressure, high temperature (LPHT) separator 124 while a lower boiling (gas) portion from the HPHT separator 122 can be passed to a high temperature, low pressure (HTLP) separator 126. The higher boiling portion from the LPHT separator 124 can be passed into a fractionator 130. The lower boiling portion from LPHT separator 124 can be combined with the higher boiling portion from HPLT separator 126 and passed into a low pressure, low temperature (LPLT) separator 128. The lower boiling portion from HPLT separator 126 can be used as a recycled hydrogen stream 142, optionally after removal of gas phase contaminants from the stream such as $H_2S$ or $NH_3$. The lower boiling portion from LPLT separator 128 can be used as a flash gas or fuel gas 141. The higher boiling portion from LPLT separator 128 is also passed into fractionator 130.

In some configurations, HPHT separator 122 can operate at a temperature similar to the outlet temperature of the slurry HDC reactor 110. This reduces the amount of energy required to operate the HPHT separator 122. However, this also means that both the lower boiling portion and the higher boiling portion from the HPHT separator 122 undergo the full range of distillation and further processing steps prior to any recycling of unconverted feed to reactor 110.

In an alternative configuration, the higher boiling portion from HPHT separator 122 is used as a recycle stream 118 that is added back into feed 105 for processing in reactor 110. In this type of alternative configuration, the effluent from reactor 110 can be heated to reduce the amount of converted material that is recycled via recycle stream 118. This allows the conditions in HPHT separator 122 to be separated from the reaction conditions in reactor 110.

In FIG. 1, fractionator 130 is shown as an atmospheric fractionator. The fractionator 130 can be used to form a plurality of product streams, such as a light ends or $C4^-$ stream 143, one or more naphtha streams 145, one or more diesel and/or distillate (including kerosene) fuel streams 147, and a bottoms fraction. The bottoms fraction can then be passed into vacuum fractionator 135 to form, for example, a light vacuum gas oil 152, a heavy vacuum gas oil 154, and a bottoms or pitch fraction 156. Optionally, other types and/or more types of vacuum gas oil fractions can be generated from vacuum fractionator 135. The heavy vacuum gas oil fraction 154 can be at least partially used to form a recycle stream 155 for combination with heavy oil feed 105.

In a reaction system, slurry hydroconversion can be performed by processing a feed in one or more slurry hydroconversion reactors. The reaction conditions in a slurry hydroconversion reactor can vary based on the nature of the catalyst, the nature of the feed, the desired products, and/or the desired amount of conversion.

With regard to catalyst, suitable catalyst concentrations can range from about 50 wppm to about 20,000 wppm (or about 2 wt %), depending on the nature of the catalyst. Catalyst can be incorporated into a hydrocarbon feedstock directly, or the catalyst can be incorporated into a side or slip stream of feed and then combined with the main flow of feedstock. Still another option is to form catalyst in-situ by introducing a catalyst precursor into a feed (or a side/slip stream of feed) and forming catalyst by a subsequent reaction.

Catalytically active metals for use in hydroprocessing can include those from Group IVB, Group VB, Group VIB, Group VIIB, or Group VIII of the Periodic Table. Examples of suitable metals include iron, nickel, molybdenum, vanadium, tungsten, cobalt, ruthenium, and mixtures thereof. The catalytically active metal may be present as a solid particulate in elemental form or as an organic compound or an inorganic compound such as a sulfide (e.g., iron sulfide) or other ionic compound. Metal or metal compound nanoaggregates may also be used to form the solid particulates.

A catalyst in the form of a solid particulate is generally a compound of a catalytically active metal, or a metal in elemental form, either alone or supported on a refractory material such as an inorganic metal oxide (e.g., alumina, silica, titania, zirconia, and mixtures thereof). Other suitable refractory materials can include carbon, coal, and clays. Zeolites and non-zeolitic molecular sieves are also useful as solid supports. One advantage of using a support is its ability to act as a "coke getter" or adsorbent of asphaltene precursors that might otherwise lead to fouling of process equipment.

In some aspects, it can be desirable to form catalyst for slurry hydroconversion in situ, such as forming catalyst from a metal sulfate (e.g., iron sulfate monohydrate) catalyst precursor or another type of catalyst precursor that decomposes or reacts in the hydroprocessing reaction zone environment, or in a pretreatment step, to form a desired, well-dispersed and catalytically active solid particulate (e.g., as iron sulfide). Precursors also include oil-soluble organometallic compounds containing the catalytically active metal of interest that thermally decompose to form the solid particulate (e.g., iron sulfide) having catalytic activity. Other suitable precursors include metal oxides that may be converted to catalytically active (or more catalytically active) compounds such as metal sulfides. In a particular embodiment, a metal oxide containing mineral may be used as a precursor of a solid particulate comprising the catalytically active metal (e.g., iron sulfide) on an inorganic refractory metal oxide support (e.g., alumina).

The reaction conditions within a slurry hydroconversion reactor can include a temperature of about 400° C. to about 480° C., such as at least about 425° C., or about 450° C. or less. Some types of slurry hydroconversion reactors are operated under high hydrogen partial pressure conditions, such as having a hydrogen partial pressure of about 1200 psig (8.3 MPag) to about 3400 psig (23.4 MPag), for example at least about 1500 psig (10.3 MPag), or at least about 2000 psig (13.8 MPag). Examples of hydrogen partial pressures can be about 1200 psig (8.3 MPag) to about 3000 psig (20.7 MPag), or about 1200 psig (8.3 MPag) to about 2500 psig (17.2 MPag), or about 1500 psig (10.3 MPag) to about 3400 psig (23.4 MPag), or about 1500 psig (10.3 MPag) to about 3000 psig (20.7 MPag), or about 1500 psig (8.3 MPag) to about 2500 psig (17.2 MPag), or about 2000 psig (13.8 MPag) to about 3400 psig (23.4 MPag), or about 2000 psig (13.8 MPag) to about 3000 psig (20.7 MPag). Since the catalyst is in slurry form within the feedstock, the space velocity for a slurry hydroconversion reactor can be characterized based on the volume of feed processed relative to the volume of the reactor used for processing the feed. Suitable space velocities for slurry hydroconversion can range, for example, from about 0.05 v/v/hr$^{-1}$ to about 5 v/v/hr$^{-1}$, such as about 0.1 v/v/hr$^{-1}$ to about 2 v/v/hr$^{-1}$.

The reaction conditions for slurry hydroconversion can be selected so that the net conversion of feed across all slurry hydroconversion reactors (if there is more than one arranged in series) is at least about 80%, such as at least about 90%, or at least about 95%. For slurry hydroconversion, conversion is defined as conversion of compounds with boiling points greater than a conversion temperature, such as 975° F. (524° C.), to compounds with boiling points below the conversion temperature. Alternatively, the conversion temperature for defining the amount of conversion can be 1050° F. (566° C.). The portion of a heavy feed that is unconverted after slurry hydroconversion can be referred to as pitch or a bottoms fraction from the slurry hydroconversion.

In some alternative aspects, multiple slurry hydroconversion stages and/or reactors can be used for conversion of a feed. In such aspects, the effluent from a first slurry hydroconversion stage can be fractionated to separate out one or more product fractions. For example, the feed can be fractionated to separate out one or more naphtha fractions and/or distillate fuel (such as diesel) fractions. Such a fractionation can also separate out lower boiling compounds, such as compounds containing 4 carbons or less and contaminant gases such as $H_2S$ or $NH_3$. The remaining higher boiling fraction of the feed can have a boiling range roughly corresponding to an atmospheric resid, such as a 10 wt % boiling point of at least about 650° F. (343° C.) or at least about 700° F. (371° C.). At least a portion of this higher boiling fraction can be passed into a second (or later) slurry hydroconversion stage for additional conversion of the 975° F.+ (524° C.) portion, or optionally the 1050° F.+ (566° C.) portion of the feed. By separating out the lower boiling portions after performing an intermediate level of conversion, the amount of "overcracking" of desirable products can be reduced or minimized.

In aspects where multiple slurry hydroconversion stages are used to achieve an overall conversion level, the conditions for an initial slurry hydroconversion stage can be selected to achieve about 25 wt % to about 60 wt % conversion on the 975° F.+ (524° C.) portion, or optionally the 1050° F.+ (566° C.) portion of the feed, such as at least about 35 wt % or at least about 45 wt %, or about 50 wt % or less, or about 40 wt % or less. The conditions in a second (or other subsequent) slurry hydroconversion stage can then be selected to achieve a total desired level of conversion for the 975° F.+ (524° C.) portion or 1050° F.+ (566° C.) portion of the feed as described above.

In some aspects, using multiple stages of slurry hydroconversion reactors can allow for selection of different processing conditions in the stages and/or reactors. For example, the temperature in the first slurry hydroconversion reactor can be lower than the temperature in a second reactor. In such an aspect, the second effective hydroprocessing conditions for use in the second slurry hydroconversion reactor can include a temperature that is at least about 5° C. greater than a temperature for the first effective slurry hydroprocessing conditions in the first reactor, or at least about 10° C. greater, or at least about 15° C. greater, or at least about 20° C. greater, or at least about 30° C. greater, or at least about 40° C. greater, or at least about 50° C. greater. From a practical standpoint, typical slurry hydroprocessing temperatures are from about 400° C. to about 480° C., so the difference between any two reaction stages can typically be about 80° C. or less.

Additionally or alternately to having a different temperature between slurry hydroconversion stages, the hydrogen partial pressure and/or total pressure used in a first slurry hydroconversion stage can differ from a second slurry hydroconversion stage. One option is to have a lower hydrogen partial pressure and/or lower total pressure for a first slurry hydroconversion stage. This can reflect the desire to have lower severity conditions in the first slurry hydroconversion stage relative to a subsequent stage. For example, the hydrogen partial pressure in a first slurry hydroconversion stage can be lower than a hydrogen partial pressure in a subsequent (such as a second or later) slurry hydroconversion stage by at least about 50 psi (350 kPa), or at least about 100 psi (690 kPa), or at least about 200 psi (1380 kPa). In aspects where roughly comparable amounts of hydrogen are delivered in the treat gases to various stages, one option for controlling the hydrogen partial pressure can be to select a lower total pressure for a first stage relative to a subsequent stage. For example, the total pressure in a first slurry hydroconversion stage can be lower than a total pressure in a subsequent (such as a second or later) slurry hydroconversion stage by at least about 50 psi (350 kPa), or at least about 100 psi (690 kPa), or at least about 200 psi (1380 kPa), or at least about 300 psi (2070 kPa). Still another alternative can be to have a lower hydrogen partial pressure in a second or other subsequent slurry hydroconversion stage relative to a first slurry hydroconversion stage. For example, the hydrogen partial pressure in a second (or other subsequent) slurry hydroconversion stage can be lower than a hydrogen partial pressure in a first slurry hydroconversion stage by at least about 50 psi (350 kPa), or at least about 100 psi (690 kPa), or at least about 200 psi (1380 kPa).

When multiple reactors are used, the catalyst for the slurry hydroconversion can be passed between reactors with a single recycle loop. In this type of configuration, catalyst is separated from the heavy product fraction of the final hydroconversion stage and then at least partially recycled to an earlier hydroconversion stage. Alternatively, a separate catalyst recycle loop can be used for at least one slurry hydroconversion stage. For example, if a plurality of reactors are used, the slurry catalyst can be separated from the heavy portion of the effluent from each reactor. The separated catalyst from the first reactor can then be recycled back to the first reactor, the separated catalyst from the second reactor can be recycled back to the second reactor, and separated catalyst from each additional reactor (if any) can be recycled to the corresponding reactor. Still another option is to have multiple catalyst separations and recycle loops, but to have fewer recycle loops than the total number of reactors. For example, a first reactor can have a separate catalyst recycle loop, while catalyst can be passed between a second and third reactor, with catalyst separated from the product effluent of the third reactor and recycled (at least in part) back to the second reactor.

When more than one catalyst recycle loop is used, the catalyst recycle loop for a stage can be effective for reducing the weight percentage of catalyst in an output fraction. For example, the weight percentage of catalyst in an output fraction after catalyst separation can be about 25% or less of the weight percentage in the fraction prior to separation, or about 15% or less, or about 10% or less.

Figure 4:
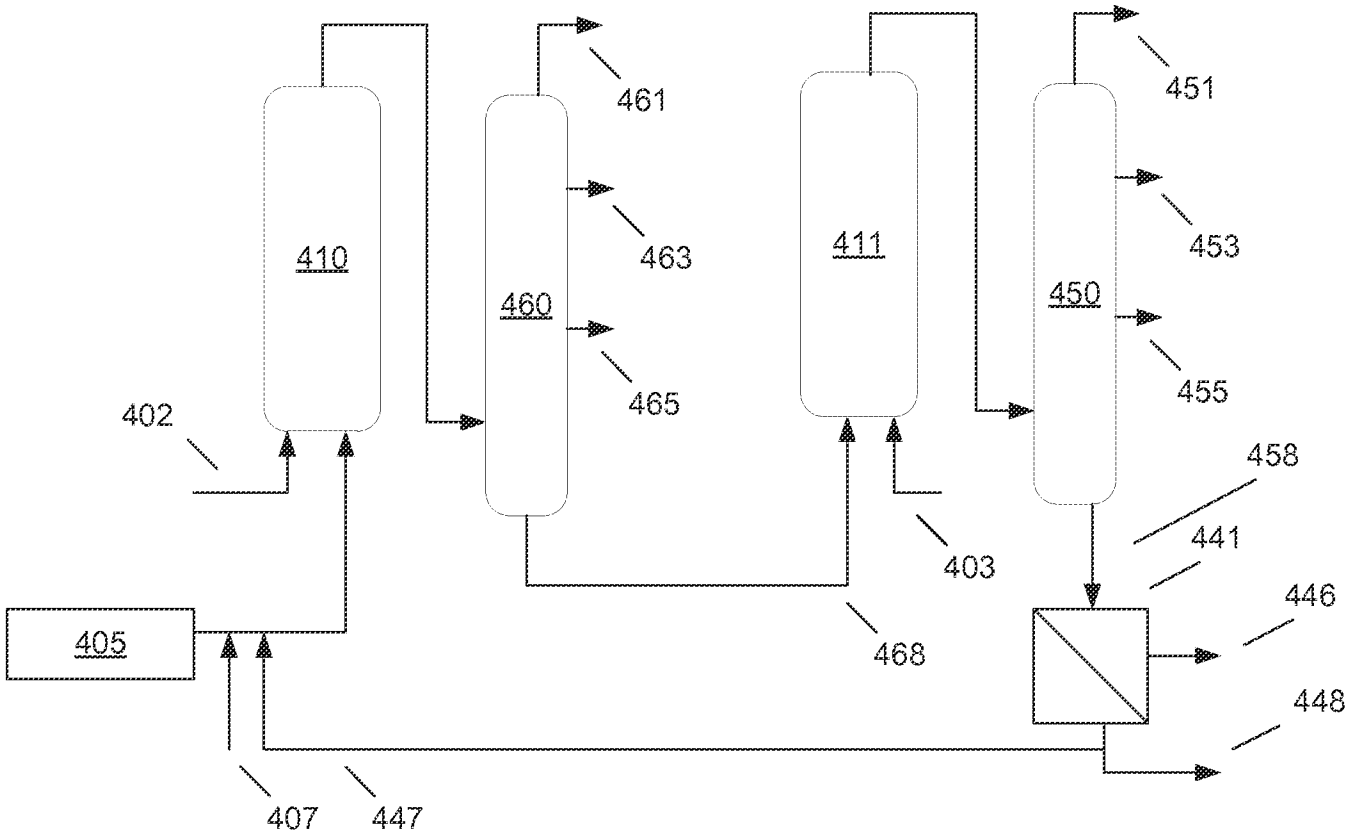
FIG. 4 shows an example of a configuration involving multiple slurry hydroconversion reactors with interstage separation.

FIG. 4 shows an example of an alternative configuration for performing slurry hydroprocessing using multiple stages and/or reactors. In a configuration such as FIG. 4, multiple stages of slurry hydroprocessing can be performed under different processing conditions. A separation or fractionation can be performed between stages to allow for removal of product fractions. This can increase the recovery of higher value products by reducing or minimizing overprocessing of the feedstock to the slurry hydroprocessing stages.

In FIG. 4, a heavy oil feed 405 (or a feed including at least a heavy oil portion) is passed into a slurry hydroconversion reactor 410. In the configuration shown in FIG. 4, an input stream of hydrogen 402 is also introduced into reactor 410. The input stream of hydrogen 402 can correspond to a fresh hydrogen stream, a recycled hydrogen stream from a downstream stage of the reaction system, or another convenient hydrogen stream. Optionally, hydrogen stream 402 can be mixed with feed 405 prior to entering reactor 410. In the configuration shown in FIG. 4, a stream of recycled catalyst 447 is shown as being mixed with feed 405. The catalyst from recycled catalyst stream 447 can be supplemented with additional fresh catalyst 407.

The feed 405 (including catalyst from recycled catalyst stream 447 and/or fresh catalyst 407) is passed into slurry hydroprocessing reactor 410. The reactor 410 can be operated under effective slurry hydroprocessing conditions for converting a portion of the resid in the feed. Because the configuration in FIG. 4 includes multiple slurry hydroconversion reactors, the effective conditions can be selected to produce an intermediate amount of conversion, such as about 20 wt % to about 60 wt % of the 975° F.+ portion of the feed. The effluent from reactor 410 can be separated or fractionated, such as in a fractionator 460. This can form a variety of fractions, such as a light ends fraction 461, a naphtha fraction 463, a diesel fraction 465, and a higher boiling fraction 468. It is noted that the catalyst in the slurry can be primarily entrained in the higher boiling fraction 468.

The higher boiling fraction 468 can be passed into a second slurry hydroconversion reactor 411 along with additional hydrogen 403. The higher boiling fraction can be processed under second effective slurry hydroprocessing conditions in reactor 411 to achieve a desired total amount of conversion of the 975° F.+ (524° C.) portion or the 1050° F.+ (566° C.) portion of the original feed. The effluent from reactor 411 can then be fractionated 450 to form, for example, a light ends fraction 451, a naphtha fraction 453, a distillate fuel fraction 455, and a higher boiling fraction 458. This higher boiling fraction 458 can correspond to a bottoms or resid fraction. The slurry catalyst can typically be entrained in the higher boiling fraction 458. The higher boiling fraction 458 can then be separated, such as by using a settler 441, a filter, or another type of separator, to separate a vacuum gas oil fraction 446 from the slurry catalyst. Optionally, at least a portion of vacuum gas oil fraction 446 can correspond to compounds having a boiling point above the conversion temperature, such as a conversion temperature of about 975° F. (524° C.) or 1050° F. (566° C.). A portion of the slurry catalyst can be purged 448 from the reaction system, while a remaining portion of the slurry catalyst can be recycled 407 for use again in the slurry hydroconversion reactors. Purging a portion of the slurry catalyst can reduce or minimize the build up of heavy metals that may deposit on the catalyst during the slurry hydroconversion process.

Figure 5:
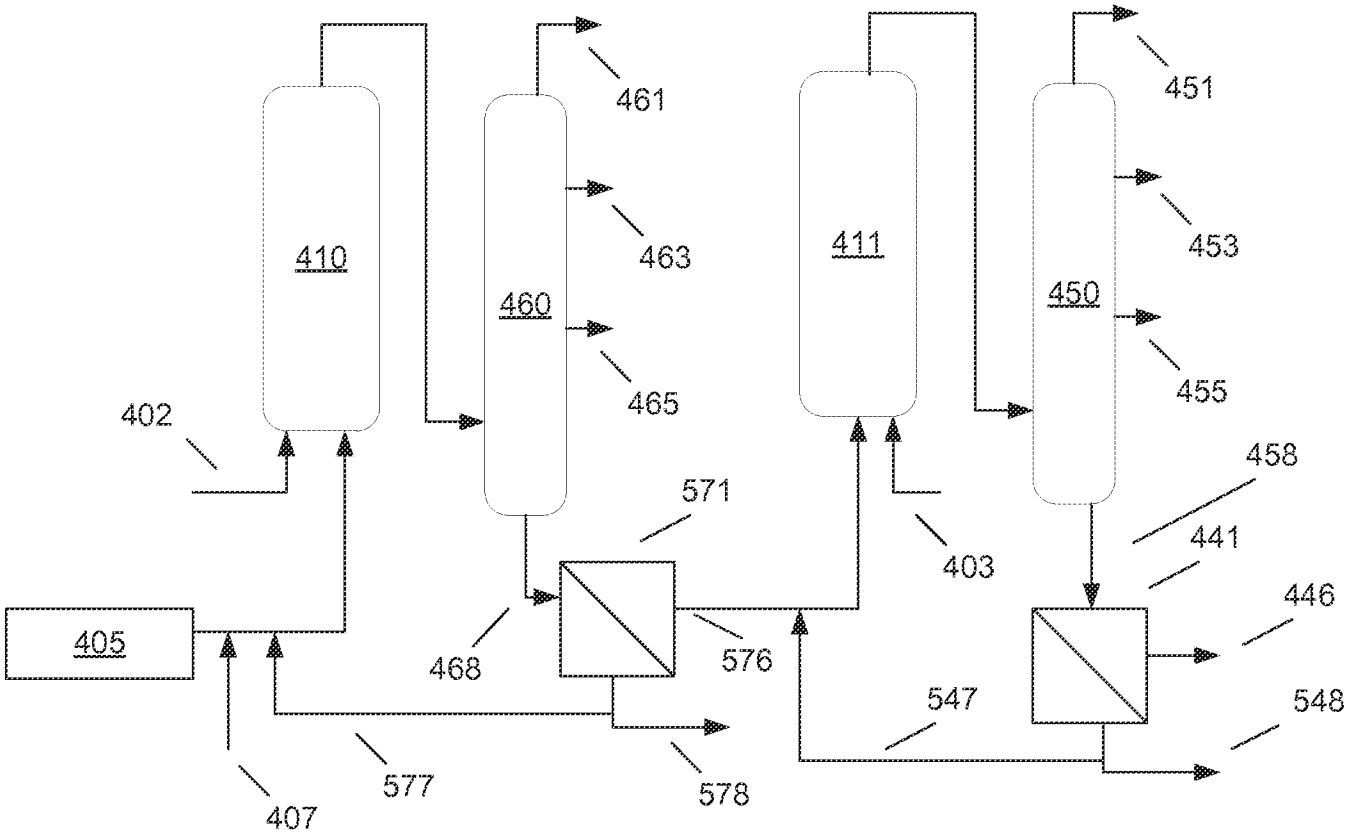
FIG. 5 shows an example of a configuration involving multiple slurry hydroconversion reactors with interstage separation.

In the configuration shown in FIG. 4, the slurry hydroprocessing catalyst is passed from the first reactor 410 to the second reactor 411 during processing. The catalyst is then separated out using settler 441 or another type of separator or filter. However, another option for handling the catalyst within multiple slurry hydroconversion reactors can be to have a separate catalyst recycle loop for each reactor and/or stage. This type of configuration is shown in FIG. 5. In FIG. 5, many of the elements shown are similar to FIG. 4. In FIG. 5, the higher boiling portion 468 of the effluent from the first slurry hydroconversion reactor 410 can typically contain a majority of the slurry catalyst, such as at least about 50 wt % of the catalyst present in the effluent from the reactor 410 prior to fractionation. However, most of the catalyst from the first slurry hydroconversion reactor 410 is not passed into the second reactor. Instead, a settler 471 or another type of separator or filter is used to separate the catalyst from the higher boiling feed portion 468. This results in a separated higher boiling portion 576 that includes a weight percentage of catalyst that is about 25% or less of the weight percentage of catalyst in the higher boiling feed portion 468, or about 15% or less, or about 10% or less. After the separation, the separated higher boiling portion 576 is used as the input feed for the second slurry hydroconversion reactor 411. A portion of the separated catalyst is purged from the system 578, while a remaining portion of the separated catalyst is recycled 576. A similar separation can be performed on the higher boiling portion 458, to produce a catalyst recycle stream 547 and a catalyst purge stream 548.

Figure 6:
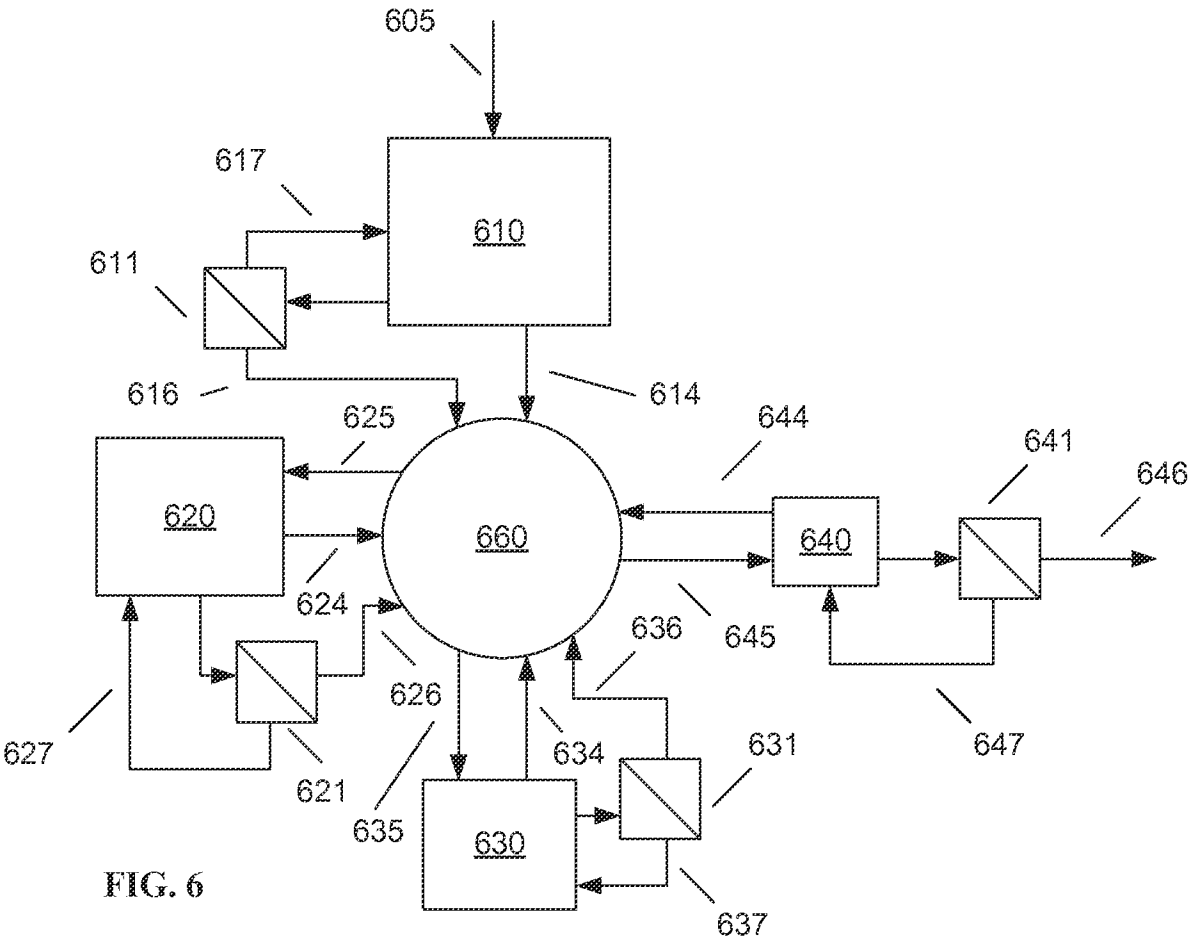
FIGS. 6 and 7 show an example of a configuration for using a divided wall fractionator in conjunction with multiple slurry hydroconversion reactors.

FIG. 6 shows still another configuration for using multiple slurry hydroconversion reactors for treatment of a feed. In FIG. 6, a configuration is schematically shown for using a single fractionator containing internal dividing walls for performing fractionation on effluents from multiple slurry hydroconversion reactors. In the example shown in FIG. 6, a fractionator 660 with internal dividing walls is shown as being associated with four separate slurry hydroconversion reactors 610, 620, 630, and 640. Of course, other numbers or groupings for a plurality of hydroconversion reactors can be used with a divided wall fractionator.

In the example shown in FIG. 6, a feed 605 for slurry hydroconversion (such as a resid feed) is passed into slurry hydroconversion reactor 610. In FIG. 6, a flash separator (not shown) or another simple separation device can be used to separate the effluent from the slurry hydroconversion reactor 610 into a lighter fraction 614 and a bottoms (or other higher boiling) fraction that includes the majority of the slurry catalyst. The bottoms fraction is passed through a settler 611 (or another type of separator) to produce a catalyst recycle stream 617 and a bottoms fraction 616 with a reduced content of slurry catalyst. Both lighter fraction 614 and bottoms fraction 616 with reduced content of slurry catalyst can then be passed into the divided wall fractionator 660.

Figure 7:
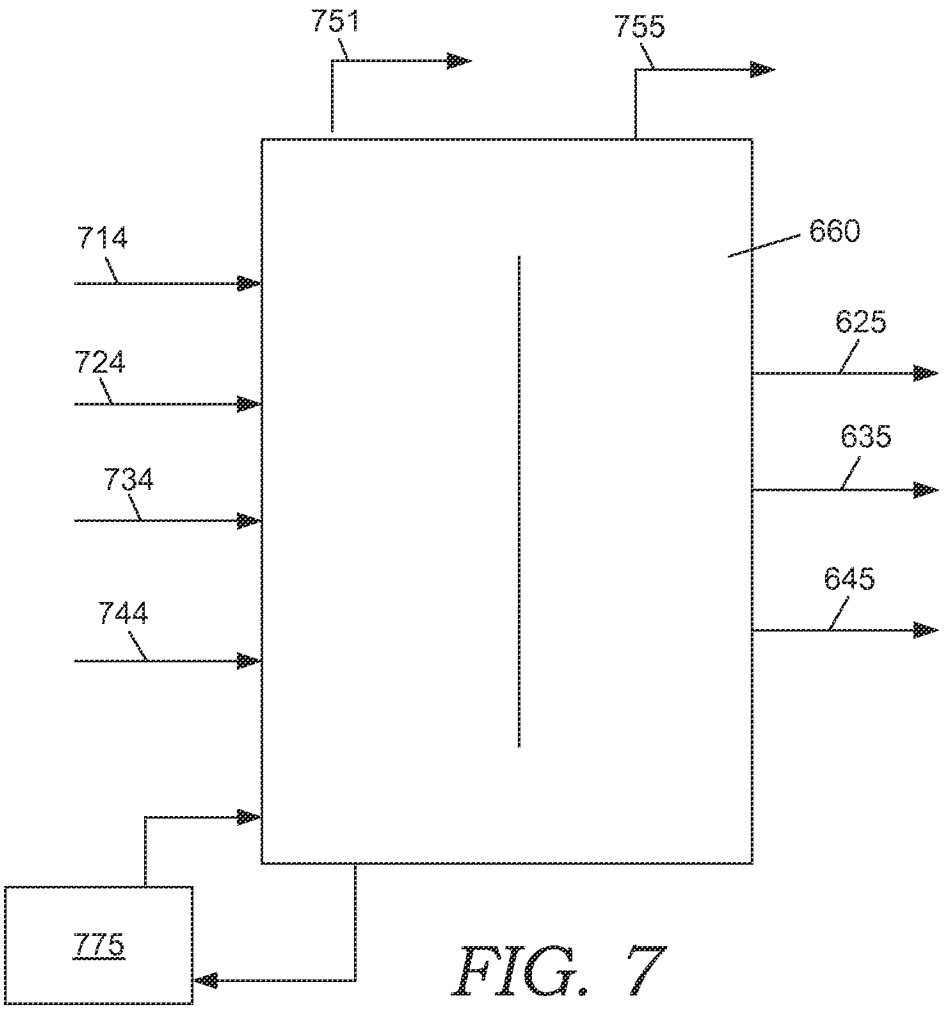

The divided wall fractionator can then be used to distribute portions of the lighter fraction 614 and bottoms fraction 616 to additional slurry hydroconversion reactors 620, 630, and 640. In FIG. 7, the lighter fraction and the bottoms fraction with reduced catalyst content from the first reactor are represented by a single input stream 714. The similar lighter fractions and bottoms fractions from the other reactors in FIG. 6 are represented by input streams 724, 734, and 744. The various fractions are introduced into the divided wall fractionator 660 on a first side of the divider. Lighter fractions are removed from the fractionator 660 above the dividing wall. This can include, for example, light ends 751 and one or more naphtha or distillate fuel fractions 755.

As shown in FIG. 7, output streams 625, 635, and 645 are withdrawn from fractionator 660 at various heights (on the opposite side of the dividing wall) corresponding to different boiling ranges within the resid boiling range. The output stream 625 is used to feed reactor 620 as shown in FIG. 6, and similarly output stream 635 feeds reactor 630 while output stream 645 feeds reactor 640. This allows reactors 620, 630, and 640 to process fractions with different boiling ranges, to allow for further adjustment of conditions in each of reactors 620, 630, and 640 to improve overall yield.

Similar to the situation for reactor 610, the stream 625/635/645 is passed into slurry hydroconversion reactor 620/630/640. In FIG. 6, a flash separator (not shown) or another simple separation device can be used to separate the effluent from the slurry hydroconversion reactor 620/630/640 into a lighter fraction 624/634/644 and a bottoms (or other higher boiling) fraction 626/636/646 that includes the majority of the slurry catalyst. The bottoms fraction 626/636/646 is passed through a settler 621/631/641 to produce a catalyst recycle stream 627/637/647 and a bottoms fraction 626/636/646 with a reduced content of slurry catalyst. For reactors 620 and 630, both lighter fraction 624/634 and bottoms fraction 626/636 with reduced content of slurry catalyst are passed into the divided wall fractionator 660. For reactor 640, the lighter fraction 644 is also passed into the divided wall fractionator 660. The bottoms fraction 646 represents a vacuum gas oil product that can be used as low sulfur fuel oil and/or can be further hydroprocessed to form additional fuel products.

Hydroprocessing for Production of Fuels and Lubricant Basestocks

A vacuum distillation can be used to separate a feed into lower boiling distillate portion(s) and a resid or bottoms portion. The lower boiling portions from a vacuum distillation can be hydroprocessed to form Group I, Group I+, Group II, Group II+, Group III base oils, or Group III+ base oils. Group I basestocks or base oils are defined as base oils with less than 90 wt % saturated molecules and/or at least 0.03 wt % sulfur content. Group I basestocks also have a viscosity index (VI) of at least 80 but less than 120. Group II basestocks or base oils contain at least 90 wt % saturated molecules and less than 0.03 wt % sulfur. Group II basestocks also have a viscosity index of at least 80 but less than 120. Group III basestocks or base oils contain at least 90 wt % saturated molecules and less than 0.03 wt % sulfur, with a viscosity index of at least 120. In addition to the above formal definitions, some Group I basestocks may be referred to as a Group I+ basestock, which corresponds to a Group I basestock with a VI value of 103 to 108. Some Group II basestocks may be referred to as a Group II+ basestock, which corresponds to a Group II basestock with a VI of at least 113. Some Group III basestocks may be referred to as a Group 111+ basestock, which corresponds to a Group III basestock with a VI value of at least 140.

In the discussion below, a stage can correspond to a single reactor or a plurality of reactors. Optionally, multiple parallel reactors can be used to perform one or more of the processes, or multiple parallel reactors can be used for all processes in a stage. Each stage and/or reactor can include one or more catalyst beds containing hydroprocessing catalyst. Note that a "bed" of catalyst in the discussion below can refer to a partial physical catalyst bed. For example, a catalyst bed within a reactor could be filled partially with a hydrocracking catalyst and partially with a dewaxing catalyst. For convenience in description, even though the two catalysts may be stacked together in a single catalyst bed, the hydrocracking catalyst and dewaxing catalyst can each be referred to conceptually as separate catalyst beds.

In the discussion herein, reference will be made to a hydroprocessing reaction system. Unless otherwise specified, a hydroprocessing reaction system is distinct from a slurry hydroconversion system. The hydroprocessing reaction system corresponds to the one or more stages, such as two stages and/or reactors and an optional intermediate separator, that are used to expose a feed to a plurality of catalysts under hydroprocessing conditions. The plurality of catalysts can be distributed between the stages and/or reactors in any convenient manner, with some preferred methods of arranging the catalyst described herein.

Various types of hydroprocessing can be used in the production of lubricant base oils, including production of lubricant base oils as one of several products generated during a fuels hydrocracking process. Typical processes include a hydrocracking process to provide uplift in the viscosity index (VI) of the feed. The hydrocracked feed can then be dewaxed to improve cold flow properties, such as pour point or cloud point. The hydrocracked, dewaxed feed can then be hydrofinished, for example, to remove aromatics from the lubricant base stock product. This can be valuable for removing compounds that are considered hazardous under various regulations. In addition to the above, a preliminary hydrotreatment and/or hydrocracking stage can also be used for contaminant removal.

Alternatively, a hydroprocessing reaction system can be a reaction system suitable for performing fuels hydrocracking. Typically this will correspond to a two stage hydrocracker, but alternatively the reaction system may include a first hydrotreater stage and a second hydrocracker stage. In still other aspects, the hydrocracking may be performed in a single stage and/or reactor, or more than two stages may be used. A separator can be used between the first stage and the second stage, such as a high temperature separator, to allow for removal of $H_2$, contaminant gases such as $NH_3$, and the portion of the feed boiling in the fuels range (naphtha and/or diesel). In order to maximize diesel production, and to improve the cold flow properties of the hydrocracker bottoms, at least a portion of the catalyst in the second hydrocracker stage can be a dewaxing catalyst. Optionally, the hydrocracker bottoms or the entire liquid effluent from the hydrocracker can also be exposed to a hydrofinishing catalyst. The hydrofinishing catalyst can be included as part of a final bed in the second hydrocracker stage or in a separate reactor. A fuels hydrocracking system can be configured to produce a lubricant base oil portion, or a recycle loop can be used to further crack the lubricant base oil boiling range components to increase the production of fuels.

Examples of Hydroprocessing Reaction System Configurations

Figure 2:
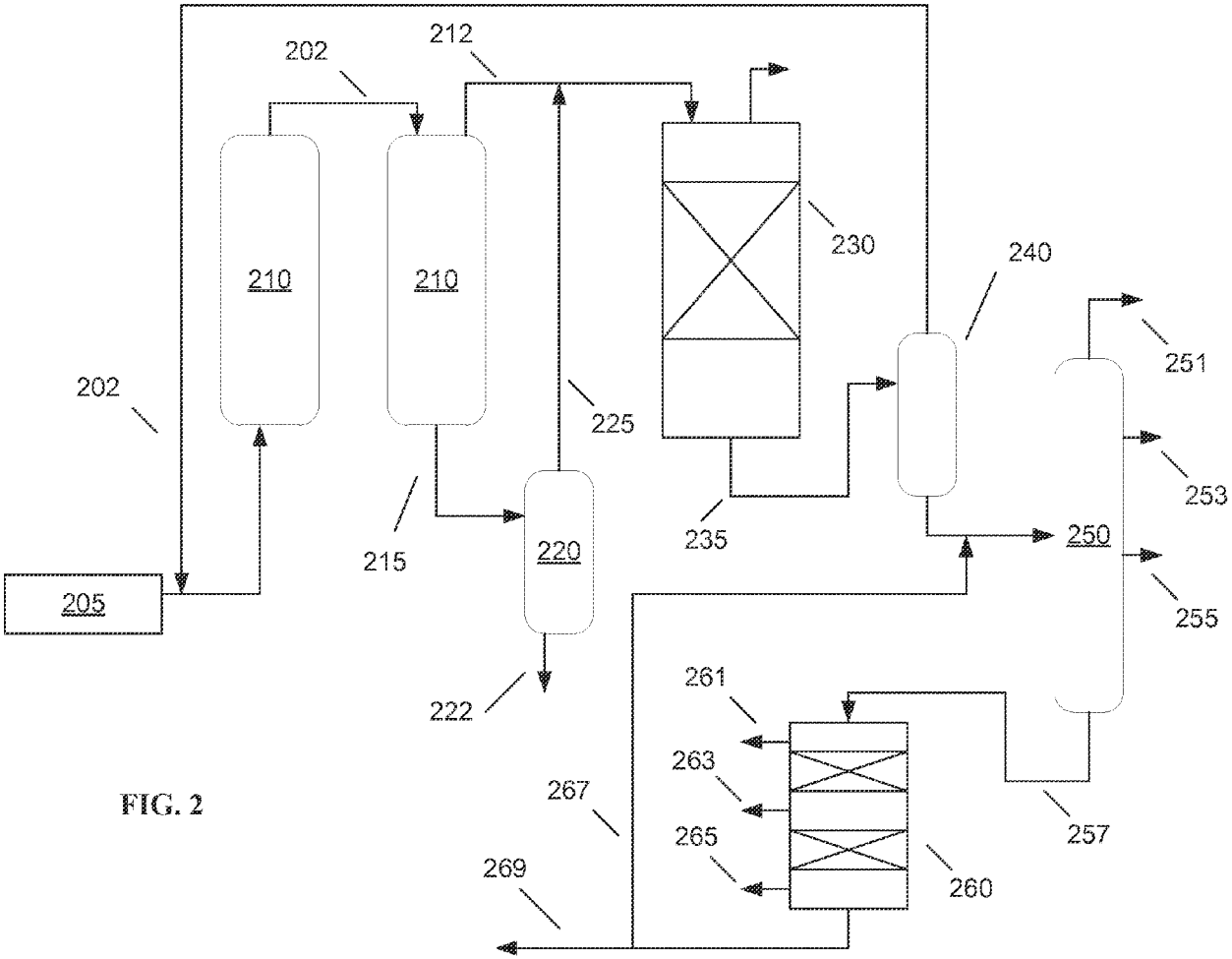
FIG. 2 shows an example of integration of a slurry hydroconversion reactor with various fixed bed reactors.

FIG. 2 shows an example of a reaction system that includes slurry hydroconversion of a heavy oil feed followed by hydroprocessing of the converted portions of the slurry hydroconversion products. In FIG. 2, a heavy oil feed 205 (or a feed including at least a heavy oil portion) is passed into a slurry hydroconversion reactor(s) 210. In the configuration shown in FIG. 2, the slurry hydroconversion reactor 210 corresponds to two reactors arranged in series. An input stream of hydrogen 202 is also introduced into reactor 210. In the configuration shown in FIG. 2, the input stream of hydrogen 202 corresponds to a recycled hydrogen stream from a downstream stage of the reaction system that is mixed with feed 205 prior to entering the first stage of reactor(s) 210. Additionally or alternately, a fresh hydrogen stream and/or other hydrogen streams can be introduced into feed 205 or reactor(s) 210.

Reactor(s) 210 generate a gas phase product 212 and a liquid phase product 215 under the slurry hydroconversion reaction conditions. The liquid phase product can be separated 220 to separate an unconverted or pitch portion 222 from the desired conversion product(s) 225. Although not shown in FIG. 2, one or more additional separation stages can be used to remove contaminant gases from either the gas phase product 212 or the liquid phase product 215. The lower boiling portions 225 and the gas phase product 212 can then be passed into a wide cut hydrotreating stage 230.

Hydrotreating stage 230 can perform additional desulfurization and/or denitrogenation so that downstream reaction stages can operate as "sweet" reaction stages. Hydrotreating stage 230 can also passivate reactive species generated during slurry hydroconversion in reactor(s) 210. The effluent 235 from hydrotreating stage 230 can also be separated in a cold separator 240 to generate a hydrogen gas product 232 suitable for use as recycled hydrogen stream 202. The remaining (liquid) portion of hydrotreating effluent 235 is passed into fractionator 250 to form various liquid products, such as a light ends cut 251, one or more naphtha cuts 253, one or more diesel (or other distillate) cuts 255, and bottoms fraction 257 that corresponds to a vacuum gas oil. As noted above, the components of the slurry hydroconversion reactor product with boiling points above the vacuum gas oil range are separated out as a pitch or bottoms product prior to hydrotreating stage 230.

The bottoms fraction 257 is then hydrocracked in a hydrocracking stage 260. In the configuration shown in FIG. 2, the bottoms portion 267 from hydrocracking stage 260 is recycled back to fractionator(s) 250. Thus, the configuration in FIG. 2 corresponds to a fuels hydrocracking process. Hydrocracking stage 260 also generates additional light ends 261, naphtha fraction(s) 263, and diesel or distillate fractions 265. The fractionator for separating the various fractions from hydrocracker 260 is not explicitly shown in FIG. 2. Alternatively, at least a portion of bottoms 267 can be used as a product 269 rather than being recycled. This alternative configuration allows for production of a lubricant base oil product. Hydrocracking stage can optionally include one or more beds of dewaxing catalyst. Alternatively, additional reactors can be used to expose the hydrocracked effluent to one or more dewaxing stages and/or one or more hydrofinishing stages.

Figure 3:
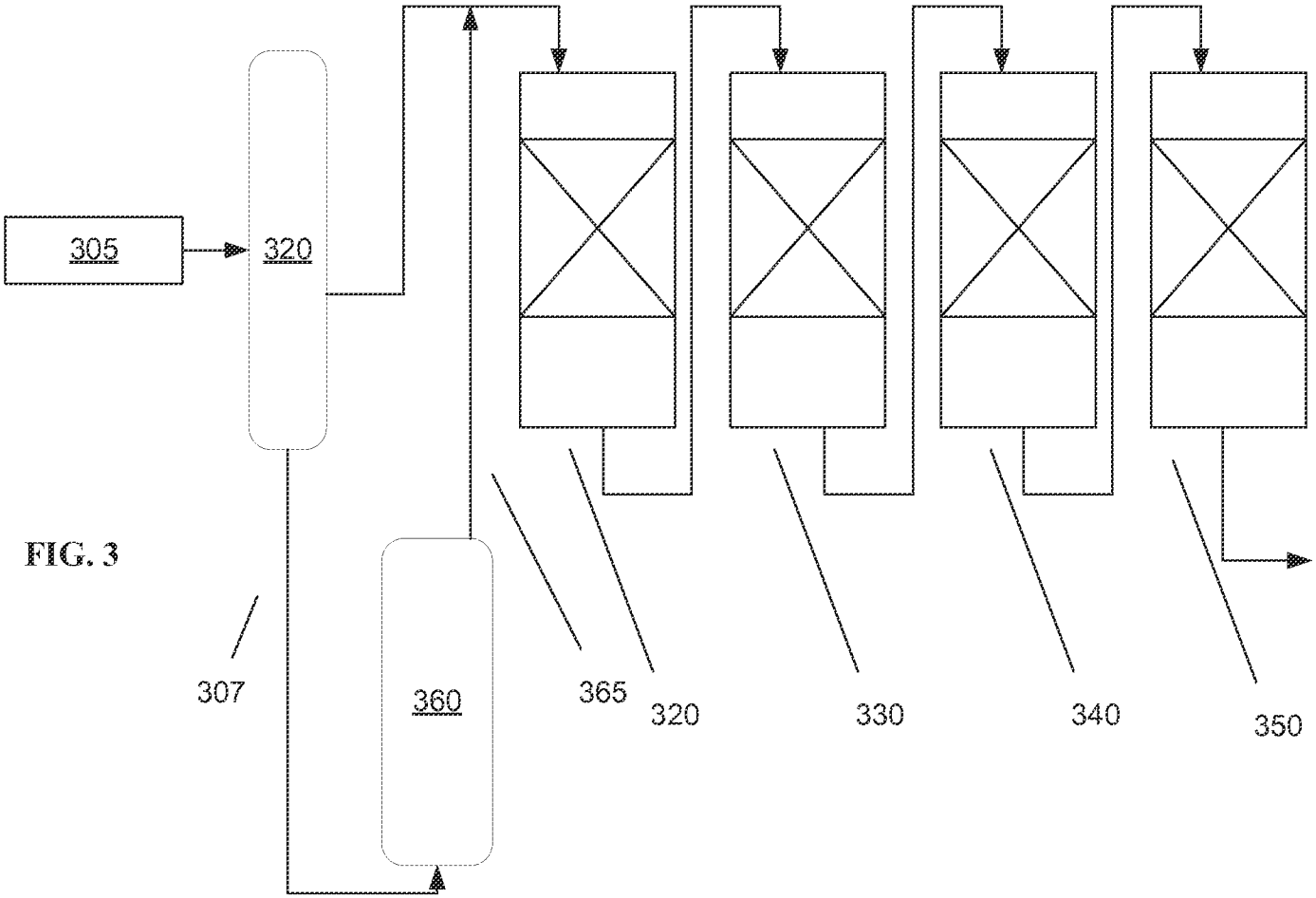
FIG. 3 shows an example of integration of a slurry hydroconversion reactor with various fixed bed reactors.

FIG. 3 shows an example of a reaction system that includes fractionating 320 a feed 305 to separate a resid 307 portion from the lower boiling portions of the feed 306. The lower boiling portions of the feed 306 are passed into a hydroprocessing reaction system. The hydroprocessing reaction system can include a hydrotreating stage 320, a hydrocracking stage 330, a dewaxing stage 340, and/or a hydrofinishing stage 350. The resid portion 307 can be passed into a slurry hydroconversion system 360. At least a portion of the converted products 365 from the slurry hydroconversion reaction system 360 can then be passed into the same hydroprocessing reaction system or a different hydroprocessing reaction system. In the configuration shown in FIG. 3, the same hydroprocessing reaction system is used for hydroprocessing of both the lower boiling portions of the feed and the converted slurry hydroconversion products.

Hydrotreatment Conditions

After slurry hydroconversion, an initial hydrotreatment stage can be used to further reduce the amount of heteroatom contaminants in the slurry hydroconversion products. Hydrotreatment is typically used to reduce the sulfur, nitrogen, and aromatic content of a feed. The catalysts used for hydrotreatment of the heavy portion of the crude oil from the flash separator can include conventional hydroprocessing catalysts, such as those that comprise at least one Group VIII non-noble metal (Columns 8-10 of IUPAC periodic table), preferably Fe, Co, and/or Ni, such as Co and/or Ni; and at least one Group VI metal (Column 6 of IUPAC periodic table), preferably Mo and/or W. Such hydroprocessing catalysts optionally include transition metal sulfides that are impregnated or dispersed on a refractory support or carrier such as alumina and/or silica. The support or carrier itself typically has no significant/measurable catalytic activity. Substantially carrier- or support-free catalysts, commonly referred to as bulk catalysts, generally have higher volumetric activities than their supported counterparts.

The catalysts can either be in bulk form or in supported form. In addition to alumina and/or silica, other suitable support/carrier materials can include, but are not limited to, zeolites, titania, silica-titania, and titania-alumina. Suitable aluminas are porous aluminas such as gamma or eta having average pore sizes from 50 to 200 Å, or 75 to 150 Å; a surface area from 100 to 300 $m^2/g$, or 150 to 250 $m^2/g$; and a pore volume of from 0.25 to 1.0 $cm^3/g$, or 0.35 to 0.8 $cm^3/g$. More generally, any convenient size, shape, and/or pore size distribution for a catalyst suitable for hydrotreatment of a distillate (including lubricant base oil) boiling range feed in a conventional manner may be used. It is within the scope of the present invention that more than one type of hydroprocessing catalyst can be used in one or multiple reaction vessels.

The at least one Group VII non-noble metal, in oxide form, can typically be present in an amount ranging from about 2 wt % to about 40 wt %, preferably from about 4 wt % to about 15 wt %. The at least one Group VI metal, in oxide form, can typically be present in an amount ranging from about 2 wt % to about 70 wt %, preferably for supported catalysts from about 6 wt % to about 40 wt % or from about 10 wt % to about 30 wt %. These weight percents are based on the total weight of the catalyst. Suitable metal catalysts include cobalt/molybdenum (1-10% Co as oxide, 10-40% Mo as oxide), nickel/molybdenum (1-10% Ni as oxide, 10-40% Co as oxide), or nickel/tungsten (1-10% Ni as oxide, 10-40% W as oxide) on alumina, silica, silica-alumina, or titania.

The hydrotreatment is carried out in the presence of hydrogen. A hydrogen stream is, therefore, fed or injected into a vessel or reaction zone or hydroprocessing zone in which the hydroprocessing catalyst is located. Hydrogen, which is contained in a hydrogen "treat gas," is provided to the reaction zone. Treat gas, as referred to in this invention, can be either pure hydrogen or a hydrogen-containing gas, which is a gas stream containing hydrogen in an amount that is sufficient for the intended reaction(s), optionally including one or more other gasses (e.g., nitrogen and light hydrocarbons such as methane), and which will not adversely interfere with or affect either the reactions or the products. Impurities, such as $H_2S$ and $NH_3$ are undesirable and would typically be removed from the treat gas before it is conducted to the reactor. The treat gas stream introduced into a reaction stage will preferably contain at least about 50 vol. % and more preferably at least about 75 vol. % hydrogen.

Hydrotreating conditions can include temperatures of 200° C. to 450° C., or 315° C. to 425° C.; pressures of 250 psig (1.8 MPag) to 5000 psig (34.6 MPag) or 300 psig (2.1 MPag) to 3000 psig (20.8 MPag); liquid hourly space velocities (LHSV) of 0.1 $hr^{-1}$ to 10 $hr^{-1}$; and hydrogen treat rates of 200 scf/B (35.6 $m^3/m^3$) to 10,000 scf/B (1781 $m^3/m^3$), or 500 (89 $m^3/m^3$) to 10,000 scf/B (1781 $m^3/m^3$).

In some aspects, a hydrotreatment stage can be operated under conditions that are influenced by the conditions in the slurry hydroconversion reactor. For example, the effluent from slurry hydroconversion can be separated using a high pressure separator, operating at roughly the pressure of the slurry hydroconversion reactor, and then passed into the hydrotreatment reactor. In this type of aspect, the pressure in the hydrotreatment reactor can be the same as or similar to the pressure in the slurry hydroconversion reactor. In other aspects, after separation the fuels and gas phase products from the slurry hydroconversion reactor can be passed into a hydrotreatment reactor. This allows hydrogen originally passed into the slurry hydroconversion reactor to be used as the hydrogen source for hydrotreatment.

Hydrocracking Conditions

In various aspects, the reaction conditions in the reaction system can be selected to generate a desired level of conversion of a feed. Conversion of the feed can be defined in terms of conversion of molecules that boil above a temperature threshold to molecules below that threshold. The conversion temperature can be any convenient temperature, such as about 700° F. (371° C.). In an aspect, the amount of conversion in the stage(s) of the reaction system can be selected to enhance diesel production while achieving a substantial overall yield of fuels. The amount of conversion can correspond to the total conversion of molecules within any stage of the fuels hydrocracker or other reaction system that is used to hydroprocess the lower boiling portion of the feed from the vacuum distillation unit. Suitable amounts of conversion of molecules boiling above 700° F. (371° C.) to molecules boiling below 700° F. include converting at least 10% of the 700° F.+ portion of the feedstock to the stage(s) of the reaction system, such as at least 20% of the 700° F.+ portion, or at least 30%. Additionally or alternately, the amount of conversion for the reaction system can be about 85% or less, or about 70% or less, or about 55% or less, or about 40% or less. Still larger amounts of conversion may also produce a suitable hydrocracker bottoms for forming lubricant base oils, but such higher conversion amounts will also result in a reduced yield of lubricant base oils. Reducing the amount of conversion can increase the yield of lubricant base oils, but reducing the amount of conversion to below the ranges noted above may result in hydrocracker bottoms that are not suitable for formation of Group II, Group II+, or Group III lubricant base oils.

In order to achieve a desired level of conversion, a reaction system can include at least one hydrocracking catalyst. Hydrocracking catalysts typically contain sulfided base metals on acidic supports, such as amorphous silica alumina, cracking zeolites such as USY, or acidified alumina. Often these acidic supports are mixed or bound with other metal oxides such as alumina, titania or silica. Examples of suitable acidic supports include acidic molecular sieves, such as zeolites or silicoaluminophophates. One example of suitable zeolite is USY, such as a USY zeolite with cell size of 24.30 Angstroms or less. Additionally or alternately, the catalyst can be a low acidity molecular sieve, such as a USY zeolite with a Si to Al ratio of at least about 20, and preferably at least about 40 or 50. ZSM-48, such as ZSM-48 with a $SiO_2$ to $Al_2O_3$ ratio of about 110 or less, such as about 90 or less, is another example of a potentially suitable hydrocracking catalyst. Still another option is to use a combination of USY and ZSM-48. Still other options include using one or more of zeolite Beta, ZSM-5, ZSM-35, or ZSM-23, either alone or in combination with a USY catalyst. Non-limiting examples of metals for hydrocracking catalysts include metals or combinations of metals that include at least one Group VIII metal, such as nickel, nickel-cobalt-molybdenum, cobalt-molybdenum, nickel-tungsten, nickel-molybdenum, and/or nickel-molybdenum-tungsten. Additionally or alternately, hydrocracking catalysts with noble metals can also be used. Non-limiting examples of noble metal catalysts include those based on platinum and/or palladium. Support materials which may be used for both the noble and non-noble metal catalysts can comprise a refractory oxide material such as alumina, silica, alumina-silica, kieselguhr, diatomaceous earth, magnesia, zirconia, or combinations thereof, with alumina, silica, alumina-silica being the most common (and preferred, in one embodiment).

In various aspects, the conditions selected for hydrocracking for fuels hydrocracking and/or lubricant base stock production can depend on the desired level of conversion, the level of contaminants in the input feed to the hydrocracking stage, and potentially other factors. For example, hydrocracking conditions in a single stage, or in the first stage and/or the second stage of a multi-stage system, can be selected to achieve a desired level of conversion in the reaction system. Hydrocracking conditions can be referred to as sour conditions or sweet conditions, depending on the level of sulfur and/or nitrogen present within a feed. For example, a feed with 100 wppm or less of sulfur and 50 wppm or less of nitrogen, preferably less than 25 wppm sulfur and/or less than 10 wppm of nitrogen, represent a feed for hydrocracking under sweet conditions. Preferably, a slurry hydroconversion effluent that has also been hydrotreated can have a sufficiently low content of sulfur and/or nitrogen for hydrocracking under sweet conditions.

A hydrocracking process under sour conditions can be carried out at temperatures of about 550° F. (288° C.) to about 840° F. (449° C.), hydrogen partial pressures of from about 250 psig to about 5000 psig (1.8 MPag to 34.6 MPag), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCF/B). In other embodiments, the conditions can include temperatures in the range of about 600° F. (343° C.) to about 815° F. (435° C.), hydrogen partial pressures of from about 500 psig to about 3000 psig (3.5 MPag-20.9 MPag), and hydrogen treat gas rates of from about 213 $m^3/m^3$ to about 1068 $m^3/m^3$ (1200 SCF/B to 6000 SCF/B). The LHSV relative to only the hydrocracking catalyst can be from about 0.25 $h^{-1}$ to about 50 $h^{-1}$, such as from about 0.5 $h^{-1}$ to about 20 $h^{-1}$, and preferably from about 1.0 $h^{-1}$ to about 4.0 $h^{-1}$ In some aspects, a portion of the hydrocracking catalyst and/or the dewaxing catalyst can be contained in a second reactor stage. In such aspects, a first reaction stage of the hydroprocessing reaction system can include one or more hydrotreating and/or hydrocracking catalysts. The conditions in the first reaction stage can be suitable for reducing the sulfur and/or nitrogen content of the feedstock. A separator can then be used in between the first and second stages of the reaction system to remove gas phase sulfur and nitrogen contaminants. One option for the separator is to simply perform a gas-liquid separation to remove contaminant. Another option is to use a separator such as a flash separator that can perform a separation at a higher temperature. Such a high temperature separator can be used, for example, to separate the feed into a portion boiling below a temperature cut point, such as about 350° F. (177° C.) or about 400° F. (204° C.), and a portion boiling above the temperature cut point. In this type of separation, the naphtha boiling range portion of the effluent from the first reaction stage can also be removed, thus reducing the volume of effluent that is processed in the second or other subsequent stages. Of course, any low boiling contaminants in the effluent from the first stage would also be separated into the portion boiling below the temperature cut point. If sufficient contaminant removal is performed in the first stage, the second stage can be operated as a "sweet" or low contaminant stage.

Still another option can be to use a separator between the first and second stages of the hydroprocessing reaction system that can also perform at least a partial fractionation of the effluent from the first stage. In this type of aspect, the effluent from the first hydroprocessing stage can be separated into at least a portion boiling below the distillate (such as diesel) fuel range, a portion boiling in the distillate fuel range, and a portion boiling above the distillate fuel range. The distillate fuel range can be defined based on a conventional diesel boiling range, such as having a lower end cut point temperature of at least about 350° F. (177° C.) or at least about 400° F. (204° C.) to having an upper end cut point temperature of about 700° F. (371° C.) or less or 650° F. (343° C.) or less. Optionally, the distillate fuel range can be extended to include additional kerosene, such as by selecting a lower end cut point temperature of at least about 300° F. (149° C.).

In aspects where the inter-stage separator is also used to produce a distillate fuel fraction, the portion boiling below the distillate fuel fraction includes, naphtha boiling range molecules, light ends, and contaminants such as $H_2S$. These different products can be separated from each other in any convenient manner. Similarly, one or more distillate fuel fractions can be formed, if desired, from the distillate boiling range fraction. The portion boiling above the distillate fuel range represents the potential lubricant base oils. In such aspects, the portion boiling above the distillate fuel range is subjected to further hydroprocessing in a second hydroprocessing stage.

A hydrocracking process under sweet conditions can be performed under conditions similar to those used for a sour hydrocracking process, or the conditions can be different. In an embodiment, the conditions in a sweet hydrocracking stage can have less severe conditions than a hydrocracking process in a sour stage. Suitable hydrocracking conditions for a non-sour stage can include, but are not limited to, conditions similar to a first or sour stage. Suitable hydrocracking conditions can include temperatures of about 550° F. (288° C.) to about 840° F. (449° C.), hydrogen partial pressures of from about 250 psig to about 5000 psig (1.8 MPag to 34.6 MPag), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCF/B). In other embodiments, the conditions can include temperatures in the range of about 600° F. (343° C.) to about 815° F. (435° C.), hydrogen partial pressures of from about 500 psig to about 3000 psig (3.5 MPag-20.9 MPag), and hydrogen treat gas rates of from about 213 $m^3/m^3$ to about 1068 $m^3/m^3$ (1200 SCF/B to 6000 SCF/B). The liquid hourly space velocity can vary depending on the relative amount of hydrocracking catalyst used versus dewaxing catalyst. Relative to the combined amount of hydrocracking and dewaxing catalyst, the LHSV can be from about 0.2 $h^{-1}$ to about 10 $h^{-1}$, such as from about 0.5 $h^{-1}$ to about 5 $h^{-1}$ and/or from about 1 $h^{-1}$ to about 4 $h^{-1}$. Depending on the relative amount of hydrocracking catalyst and dewaxing catalyst used, the LHSV relative to only the hydrocracking catalyst can be from about 0.25 $h^{-1}$ to about 50 $h^{-1}$, such as from about 0.5 $h^{-1}$ to about 20 $h^{-1}$, and preferably from about 1.0 $h^{-1}$ to about 4.0 $h^{-1}$.

In still another embodiment, the same conditions can be used for hydrotreating and hydrocracking beds or stages, such as using hydrotreating conditions for both or using hydrocracking conditions for both. In yet another embodiment, the pressure for the hydrotreating and hydrocracking beds or stages can be the same.

Catalytic Dewaxing Process

In order to enhance diesel production and to improve the quality of lubricant base oils produced from the bottoms of the reaction system, at least a portion of the catalyst in the final reaction stage can be a dewaxing catalyst. In some aspects, the dewaxing catalyst is located in a bed downstream from any hydrocracking catalyst stages and/or any hydrocracking catalyst present in a stage. This can allow the dewaxing to occur on molecules that have already been hydrotreated or hydrocracked to remove a significant fraction of organic sulfur- and nitrogen-containing species. Alternatively, the dewaxing catalyst can be located upstream from the hydrocracking stage(s). The dewaxing catalyst can be located in the same reactor as at least a portion of the hydrocracking catalyst in a stage. Alternatively, the effluent from a reactor containing hydrocracking catalyst, possibly after a gas-liquid separation, can be fed into a separate stage or reactor containing the dewaxing catalyst. Depending on the aspects, the amount of hydrocracking catalyst relative to the amount of dewaxing catalyst can vary from about 10:90 to about 90:10, such as from about 20:80 to about 70:30, and preferably from about 60:40 to about 40:60. Optionally, in some aspects it may be possible to omit the hydrocracking catalyst, so that only a dewaxing catalyst is used. Optionally, in some aspects it may be possible to omit the dewaxing catalyst, so that only a hydrocracking catalyst is used.

Suitable dewaxing catalysts can include molecular sieves such as crystalline aluminosilicates (zeolites). In an embodiment, the molecular sieve can comprise, consist essentially of, or be ZSM-5, ZSM-22, ZSM-23, ZSM-35, ZSM-48, zeolite Beta, or a combination thereof, for example ZSM-23 and/or ZSM-48, or ZSM-48 and/or zeolite Beta. Optionally but preferably, molecular sieves that are selective for dewaxing by isomerization as opposed to cracking can be used, such as ZSM-48, zeolite Beta, ZSM-23, or a combination thereof. Additionally or alternately, the molecular sieve can comprise, consist essentially of, or be a 10-member ring 1-D molecular sieve. Examples include EU-1, ZSM-35 (or ferrierite), ZSM-11, ZSM-57, NU-87, SAPO-1, ZSM-48, ZSM-23, and ZSM-22. Preferred materials are EU-2, EU-11, ZBM-30, ZSM-48, or ZSM-23. ZSM-48 is most preferred. Note that a zeolite having the ZSM-23 structure with a silica to alumina ratio of from about 20:1 to about 40:1 can sometimes be referred to as SSZ-32. Other molecular sieves that are isostructural with the above materials include Theta-1, NU-10, EU-13, KZ-1, and NU-23. Optionally but preferably, the dewaxing catalyst can include a binder for the molecular sieve, such as alumina, titania, silica, silica-alumina, zirconia, or a combination thereof, for example alumina and/or titania or silica and/or zirconia and/or titania.

Preferably, the dewaxing catalysts used in processes according to the invention are catalysts with a low ratio of silica to alumina. For example, for ZSM-48, the ratio of silica to alumina in the zeolite can be less than about 200:1, such as less than about 110:1, or less than about 100:1, or less than about 90:1, or less than about 75:1. In various embodiments, the ratio of silica to alumina can be from 50:1 to 200:1, such as 60:1 to 160:1, or 70:1 to 100:1.

In various embodiments, the catalysts according to the invention further include a metal hydrogenation component. The metal hydrogenation component is typically a Group VI and/or a Group VIII metal. Preferably, the metal hydrogenation component is a Group VIII noble metal. Preferably, the metal hydrogenation component is Pt, Pd, or a mixture thereof. In an alternative preferred embodiment, the metal hydrogenation component can be a combination of a non-noble Group VIII metal with a Group VI metal. Suitable combinations can include Ni, Co, or Fe with Mo or W, preferably Ni with Mo or W.

The metal hydrogenation component may be added to the catalyst in any convenient manner. One technique for adding the metal hydrogenation component is by incipient wetness. For example, after combining a zeolite and a binder, the combined zeolite and binder can be extruded into catalyst particles. These catalyst particles can then be exposed to a solution containing a suitable metal precursor. Alternatively, metal can be added to the catalyst by ion exchange, where a metal precursor is added to a mixture of zeolite (or zeolite and binder) prior to extrusion.

The amount of metal in the catalyst can be at least 0.1 wt % based on catalyst, or at least 0.15 wt %, or at least 0.2 wt %, or at least 0.25 wt %, or at least 0.3 wt %, or at least 0.5 wt % based on catalyst. The amount of metal in the catalyst can be 20 wt % or less based on catalyst, or 10 wt % or less, or 5 wt % or less, or 2.5 wt % or less, or 1 wt % or less. For embodiments where the metal is Pt, Pd, another Group VIII noble metal, or a combination thereof, the amount of metal can be from 0.1 to 5 wt %, preferably from 0.1 to 2 wt %, or 0.25 to 1.8 wt %, or 0.4 to 1.5 wt %. For embodiments where the metal is a combination of a non-noble Group VIII metal with a Group VI metal, the combined amount of metal can be from 0.5 wt % to 20 wt %, or 1 wt % to 15 wt %, or 2.5 wt % to 10 wt %.

The dewaxing catalysts useful in processes according to the invention can also include a binder. In some embodiments, the dewaxing catalysts used in process according to the invention are formulated using a low surface area binder, a low surface area binder represents a binder with a surface area of 100 $m^2/g$ or less, or 80 $m^2/g$ or less, or 70 $m^2/g$ or less. The amount of zeolite in a catalyst formulated using a binder can be from about 30 wt % zeolite to 90 wt % zeolite relative to the combined weight of binder and zeolite. Preferably, the amount of zeolite is at least about 50 wt % of the combined weight of zeolite and binder, such as at least about 60 wt % or from about 65 wt % to about 80 wt %.

A zeolite can be combined with binder in any convenient manner. For example, a bound catalyst can be produced by starting with powders of both the zeolite and binder, combining and mulling the powders with added water to form a mixture, and then extruding the mixture to produce a bound catalyst of a desired size. Extrusion aids can also be used to modify the extrusion flow properties of the zeolite and binder mixture. The amount of framework alumina in the catalyst may range from 0.1 to 3.33 wt %, or 0.1 to 2.7 wt %, or 0.2 to 2 wt %, or 0.3 to 1 wt %.

Process conditions in a catalytic dewaxing zone can include a temperature of from 200 to 450° C., preferably 270 to 400° C., a hydrogen partial pressure of from 1.8 MPag to 34.6 MPag (250 psig to 5000 psig), preferably 4.8 MPag to 20.8 MPag, and a hydrogen circulation rate of from 35.6 $m^3/m^3$ (200 SCF/B) to 1781 $m^3/m^3$ (10,000 scf/B), preferably 178 $m^3/m^3$ (1000 SCF/B) to 890.6 $m^3/m^3$ (5000 SCF/B). In still other embodiments, the conditions can include temperatures in the range of about 600° F. (343° C.) to about 815° F. (435° C.), hydrogen partial pressures of from about 500 psig to about 3000 psig (3.5 MPag-20.9 MPag), and hydrogen treat gas rates of from about 213 $m^3/m^3$ to about 1068 $m^3/m^3$ (1200 SCF. The liquid hourly space velocity can vary depending on the relative amount of hydrocracking catalyst used versus dewaxing catalyst. Relative to the combined amount of hydrocracking and dewaxing catalyst, the LHSV can be from about 0.2 $h^{-1}$ to about 10 $h^{-1}$, such as from about 0.5 $h^{-1}$ to about 5 $h^{-1}$ and/or from about 1 $h^{-1}$ to about 4 $h^{-1}$. Depending on the relative amount of hydrocracking catalyst and dewaxing catalyst used, the LHSV relative to only the dewaxing catalyst can be from about 0.25 $h^{-1}$ to about 50 $h^{-1}$, such as from about 0.5 $h^{-1}$ to about 20 $h^{-1}$, and preferably from about 1.0 $h^{-1}$ to about 4.0 $h^{-1}$.

Additionally or alternately, the conditions for dewaxing can be selected based on the conditions for a preceeding reaction in the stage, such as hydrocracking conditions or hydrotreating conditions. Such conditions can be further modified using a quench between previous catalyst bed(s) and the bed for the dewaxing catalyst. Instead of operating the dewaxing process at a temperature corresponding to the exit temperature of the prior catalyst bed, a quench can be used to reduce the temperature for the hydrocarbon stream at the beginning of the dewaxing catalyst bed. One option can be to use a quench to have a temperature at the beginning of the dewaxing catalyst bed that is about the same as the outlet temperature of the prior catalyst bed. Another option can be to use a quench to have a temperature at the beginning of the dewaxing catalyst bed that is at least about 10° F. (6° C.) lower than the prior catalyst bed, or at least about 20° F. (11° C.) lower, or at least about 30° F. (16° C.) lower, or at least about 40° F. (21° C.) lower.

As still another option, the dewaxing catalyst in the final reaction stage can be mixed with another type of catalyst, such as hydrocracking catalyst, in at least one bed in a reactor. As yet another option, a hydrocracking catalyst and a dewaxing catalyst can be co-extruded with a single binder to form a mixed functionality catalyst.

Hydrofinishing and/or Aromatic Saturation Process

In some aspects, a hydrofinishing and/or aromatic saturation stage can also be provided. The hydrofinishing and/or aromatic saturation can occur after the last hydrocracking or dewaxing stage. The hydrofinishing and/or aromatic saturation can occur either before or after fractionation. If hydrofinishing and/or aromatic saturation occurs after fractionation, the hydrofinishing can be performed on one or more portions of the fractionated product, such as being performed on the bottoms from the reaction stage (i.e., the hydrocracker bottoms). Alternatively, the entire effluent from the last hydrocracking or dewaxing process can be hydrofinished and/or undergo aromatic saturation.

In some situations, a hydrofinishing process and an aromatic saturation process can refer to a single process performed using the same catalyst. Alternatively, one type of catalyst or catalyst system can be provided to perform aromatic saturation, while a second catalyst or catalyst system can be used for hydrofinishing. Typically a hydrofinishing and/or aromatic saturation process will be performed in a separate reactor from dewaxing or hydrocracking processes for practical reasons, such as facilitating use of a lower temperature for the hydrofinishing or aromatic saturation process. However, an additional hydrofinishing reactor following a hydrocracking or dewaxing process but prior to fractionation could still be considered part of a second stage of a reaction system conceptually.

Hydrofinishing and/or aromatic saturation catalysts can include catalysts containing Group VI metals, Group VIII metals, and mixtures thereof. In an embodiment, preferred metals include at least one metal sulfide having a strong hydrogenation function. In another embodiment, the hydrofinishing catalyst can include a Group VIII noble metal, such as Pt, Pd, or a combination thereof. The mixture of metals may also be present as bulk metal catalysts wherein the amount of metal is about 30 wt. % or greater based on catalyst. Suitable metal oxide supports include low acidic oxides such as silica, alumina, silica-aluminas or titania, preferably alumina. The preferred hydrofinishing catalysts for aromatic saturation will comprise at least one metal having relatively strong hydrogenation function on a porous support. Typical support materials include amorphous or crystalline oxide materials such as alumina, silica, and silica-alumina. The support materials may also be modified, such as by halogenation, or in particular fluorination. The metal content of the catalyst is often as high as about 20 weight percent for non-noble metals. In an embodiment, a preferred hydrofinishing catalyst can include a crystalline material belonging to the M41S class or family of catalysts. The M41S family of catalysts are mesoporous materials having high silica content. Examples include MCM-41, MCM-48 and MCM-50. A preferred member of this class is MCM-41. If separate catalysts are used for aromatic saturation and hydrofinishing, an aromatic saturation catalyst can be selected based on activity and/or selectivity for aromatic saturation, while a hydrofinishing catalyst can be selected based on activity for improving product specifications, such as product color and polynuclear aromatic reduction.

Hydrofinishing conditions can include temperatures from about 125° C. to about 425° C., preferably about 180° C. to about 280° C., a hydrogen partial pressure from about 500 psig (3.4 MPa) to about 3000 psig (20.7 MPa), preferably about 1500 psig (10.3 MPa) to about 2500 psig (17.2 MPa), and liquid hourly space velocity from about 0.1 $hr^{-1}$ to about 5 $hr^{-1}$ LHSV, preferably about 0.5 $hr^{-1}$ to about 1.5 $hr^{-1}$. Additionally, a hydrogen treat gas rate of from 35.6 $m^3/m^3$ to 1781 $m^3/m^3$ (200 SCF/B to 10,000 SCF/B) can be used.

After hydroprocessing, the bottoms from the hydroprocessing reaction system can have a viscosity index (VI) of at least 95, such as at least 105 or at least 110. The amount of saturated molecules in the bottoms from the hydroprocessing reaction system can be at least about 90%, while the sulfur content of the bottoms is less than about 300 wppm. Thus, the bottoms from the hydroprocessing reaction system can be suitable for use as a Group II, Group II+, or Group III lubricant base oil.

Catalyst for Distillate Fuel Dewaxing

Another option is to perform catalytic dewaxing on the distillate fuels portion of hydrotreated effluent from slurry hydroconversion. Such catalytic dewaxing can be accomplished by selective hydrocracking and/or by isomerizing long chain molecules within a feed such as a diesel range feed. Dewaxing catalysts can be selected from molecular sieves such as crystalline aluminosilicates (zeolites) or silico-aluminophosphates (SAPOs). In an embodiment, the molecular sieve can be a 1-D or 3-D molecular sieve. In an embodiment, the molecular sieve can be a 10-member ring 1-D molecular sieve. Examples of molecular sieves can include ZSM-48, ZSM-23, ZSM-35, and combinations thereof. In an embodiment, the molecular sieve can be ZSM-48, ZSM-23, or a combination thereof. Still other suitable molecular sieves can include SSZ-32, EU-2, EU-1, and/or ZBM-30.

Optionally, the dewaxing catalyst can include a binder for the molecular sieve, such as alumina, titania, silica, silica-alumina, zirconia, or a combination thereof. In a preferred embodiment, the binder can be alumina. In another embodiment, the binder can be alumina, titania, or a combination thereof. In still another embodiment, the binder can be titania, silica, zirconia, or a combination thereof. Optionally, the binder can correspond to a binder with a relatively high surface area. One way to characterize the surface of the binder is in relation to the surface area of the molecular sieve in the dewaxing catalyst. For example, the ratio of molecular sieve surface area to binder surface can be about 80 to 100 or less, such as about 70 to 100 or less or about 60 to 100 or less.

One feature of molecular sieves that can impact the activity of the molecular sieve is the ratio of silica to alumina in the molecular sieve. In an embodiment where the molecular sieve is ZSM-48, the molecular sieve can have a silica to alumina ratio of about 110 to 1 or less, such as about 100 to 1 or less, and preferably about 90 to 1 or less, such as about 80 to 1 or less. When the molecular sieve is ZSM-48, the molecular sieve preferably has a silica to alumina ratio of at least about 70 to 1.

The dewaxing catalyst can also include a metal hydrogenation component, such as a Group VIII metal (Groups 8-10 of IUPAC periodic table). Suitable Group VIII metals can include Pt, Pd, or Ni. Preferably the Group VIII metal is a noble metal, such as Pt, Pd, or a combination thereof. The dewaxing catalyst can include at least about 0.03 wt % of a Group VIII metal, such as at least about 0.05 wt %, or preferably at least about 0.1 wt %. Additionally or alternately, the dewaxing catalyst can include about 1.0 wt % or less of a Group VIII metal, such as about 0.75 wt % or less, or about 0.6 wt % or less, or about 0.35 wt % or less, or about 0.3 wt % or less.

Catalytic dewaxing can be performed by exposing a feedstock to a dewaxing catalyst under effective (catalytic) dewaxing conditions. Effective dewaxing conditions can include a temperature of at least about 500° F. (260° C.), or at least about 550° F. (288° C.), or at least about 600° F. (316° C.), or at least about 650° F. (343° C.). Alternatively, the temperature can be about 750° F. (399° C.) or less, or about 700° F. (371° C.) or less, or about 650° F. (343° C.) or less. The pressure can be at least about 200 psig (1.4 MPa), or at least about 500 psig (3.4 MPa), or at least about 750 psig (5.2 MPa), or at least about 1000 psig (6.9 MPa). Alternatively, the pressure can be about 1500 psig (10.3 MPa) or less, or about 1200 psig (8.2 MPa) or less, or about 1000 psig (6.9 MPa) or less, or about 800 psig (5.5 MPa) or less. The Liquid Hourly Space Velocity (LHSV) can be at least about 0.5 $hr^{-1}$, or at least about 1.0 $hr^{-1}$, or at least about 1.5 $hr^{-1}$. Alternatively, the LHSV can be about 5.0 $hr^{-1}$ or less, or about 3.0 $hr^{-1}$ or less, or about 2.0 $hr^{-1}$ or less. The treat gas rate can be at least about 500 scf/bbl (84 $m^3/m^3$), at least about 750 scf/bbl (126 $m^3/m^3$), or at least about 1000 scf/bbl (169 $m^3/m^3$). Alternatively, the treat gas rate can be about 4000 scf/bbl (674 $m^3/m^3$) or less, or about 2000 scf/bbl (337 $m^3/m^3$) or less, or about 1500 scf/bbl (253 $m^3/m^3$) or less, or about 1250 scf/bbl (211 $m^3/m^3$) or less.

Based on dewaxing under effective catalytic dewaxing conditions, the cloud point of a dewaxed distillate fuel fraction can be reduced relative to the feedstock by at least about 10° F. (5° C.), such as at least about 20° F. (1° C.), or at least about 30° F. (17° C.). Additionally or alternately, in an aspect where the feedstock is hydrotreated prior to dewaxing, the cloud point of a dewaxed distillate fuel fraction can be reduced relative to the hydrotreated effluent by at least about 10° F. (5° C.), such as at least about 20° F. (11° C.), or at least about 30° F. (17° C.). The amount of cloud point reduction can depend on a variety of factors, including the sulfur content of the feedstock, the nitrogen content of the feedstock, and the selected effective dewaxing conditions.

ADDITIONAL EMBODIMENTS

Embodiment 1

A method for processing a heavy oil feedstock, comprising: providing a heavy oil feedstock having an initial boiling point of at least about 650° F. (343° C.) and a first Conradson carbon residue wt %; exposing the heavy oil feedstock to a catalyst under effective slurry hydroconversion conditions to form at least a first liquid product, the effective slurry hydroconversion conditions being effective for conversion of at least about 90 wt % of the heavy oil feedstock relative to a conversion temperature; hydrotreating the first liquid product under effective hydrotreating conditions to form a first hydrotreated liquid product; fractionating the first hydrotreated liquid product to form one or more naphtha boiling range products, one or more distillate fuel boiling range products, and one or more lubricating base oil boiling range products; and hydrocracking at least a portion of the one or more lubricating base oil boiling range products to form at least one hydrocracked fuel product and a hydrocracking bottoms product.

Embodiment 2

A method for processing a heavy oil feedstock, comprising: providing a heavy oil feedstock having a 5 wt % boiling point of at least about 650° F. (343° C.) and a first Conradson carbon residue wt %; exposing the heavy oil feedstock to a catalyst under effective slurry hydroconversion conditions to form at least a first liquid product, the effective slurry hydroconversion conditions being effective for conversion of at least about 90 wt % of the heavy oil feedstock relative to a conversion temperature; hydrotreating the first liquid product under effective hydrotreating conditions to form a first hydrotreated liquid product; fractionating the first hydrotreated liquid product to form one or more naphtha boiling range products, one or more distillate fuel boiling range products, and one or more lubricating base oil boiling range products; and hydrocracking at least a portion of the one or more lubricating base oil boiling range products to form at least one hydrocracked fuel product and a hydrocracking bottoms product.

Embodiment 3

The method of any of the above embodiments, further comprising recycling at least a portion of the hydrocracking bottoms product, the hydrocracking of the at least a portion of the one or more lubricating base oil boiling range products further comprising hydrocracking the hydrocracking bottoms product.

Embodiment 4

The method of Embodiments 1 or 2, further comprising dewaxing at least a portion of the hydrocracking bottoms product under effective dewaxing conditions, hydrofinishing at least a portion of the hydrocracking bottom products under effective hydrofinishing conditions, or a combination thereof.

Embodiment 5

The method of any of the above embodiments, wherein the heavy oil feedstock has a 10% distillation point of at least about 900° F. (482° C.), a Conradson carbon residue of at least about 27.5 wt % and optionally at least about 30.0 wt %, or a combination thereof.

Embodiment 6

The method of any of the above claims, wherein exposing the heavy oil feedstock to a catalyst under effective slurry hydroconversion conditions further comprises forming an unconverted slurry hydroconversion pitch.

Embodiment 7

The method of any of the above claims, wherein the hydrocracking catalyst comprises a molecular sieve selected from USY, ZSM-48, or a combination thereof.

Embodiment 8

The method of any of the above claims, further comprising dewaxing a portion of at least one of the one or more distillate fuel boiling range products under effective distillate fuel dewaxing conditions.

Embodiment 9

The method of any of the above claims, wherein exposing the heavy oil feedstock to a catalyst under effective slurry hydroconversion conditions to form at least a first liquid product comprises: exposing the heavy oil feedstock to a first catalyst under first effective slurry hydroconversion conditions to form a first slurry hydroconversion effluent; and exposing at least a portion of the first slurry hydroconversion effluent to a second catalyst under second effective slurry hydroconversion conditions to form a second slurry hydroconversion effluent, the first liquid product comprising at least a portion of the second slurry hydroconversion effluent.

Embodiment 10

The method of Embodiment 9, wherein a temperature of the second effective slurry hydroconversion conditions is greater than a temperature of the first effective slurry hydroconversion conditions by about 10° C. to about 80° C., optionally at least about 20° C. and optionally about 50° C. or less.

Embodiment 11

The method of Embodiment 9 or 10, further comprising fractionating the first slurry hydroconversion effluent to form at least one of a naphtha fraction or a distillate fuel fraction, and at least one slurry resid or bottoms fraction, the slurry resid or bottoms fraction containing a portion of the first catalyst corresponding to at least about 50% of the first catalyst in the first slurry hydroconversion effluent, wherein exposing at least a portion of the first slurry hydroconversion effluent to the second catalyst comprises exposing at least a portion of the slurry resid or bottoms fraction to the second catalyst, the second catalyst optionally comprising the portion of the first catalyst contained in the slurry resid or bottoms fraction.

Embodiment 12

The method of Embodiment 11, further comprising separating the slurry resid or bottoms fraction to form a first catalyst fraction and a catalyst-depleted resid or bottoms fraction, the catalyst-depleted resid or bottoms fraction containing about 25 wt % or less of the catalyst in the slurry resid or bottoms fraction prior to separation, wherein exposing at least a portion of the slurry resid or bottoms fraction to the second catalyst comprises exposing at least a portion of the catalyst-depleted resid or bottoms fraction to the second catalyst, the method optionally further comprising introducing the second catalyst into the catalyst-depleted resid or bottoms fraction.

Embodiment 13

The method of any of Embodiments 11 or 12, wherein the first slurry hydroconversion effluent is fractionated in a divided wall fractionator, the method further comprising fractionating the second slurry hydroconversion effluent in the divided wall fractionator.

Embodiment 14

The method of any of Embodiments 1 or 3-13, wherein providing a heavy oil feedstock having an initial boiling point of at least about 650° F. (343° C.) and a first Conradson carbon residue wt % comprises: separating a feedstock to form at least a bottoms fraction having a 10% distillation temperature of at least 900° F. (482° C.) and a liquid fraction having a lower boiling range than the bottoms fraction, the bottoms fraction optionally having a 10% distillation temperature of at least about 1000° F.; hydrotreating at least a portion of the liquid fraction having a lower boiling range than the bottoms fraction under second effective hydrotreating conditions to form a second hydrotreated effluent; fractionating the second hydrotreated effluent to form a second plurality of hydrotreated liquid fractions, the second plurality of hydrotreated liquid fractions including a second lubricant base oil boiling range fraction; hydrocracking at least a portion of the second lubricant boiling range fraction under second effective hydrocracking conditions to form at least one second hydrocracked fuel product and a second hydrocracking bottoms product; and providing at least a portion of the bottoms fraction as the heavy oil feedstock.

Embodiment 15

The method of Embodiment 14, further comprising dewaxing at least a portion of the second hydrocracking bottoms product under second effective dewaxing conditions, or hydrofinishing at least a portion of the second hydrocracking bottoms product under second effective hydrofinishing conditions, or a combination thereof.

Embodiment 16

A method for processing a heavy oil feedstock, comprising: separating a feedstock to form at least a bottoms fraction having a 10% distillation temperature of at least 900° F. and a first plurality of liquid products having a lower boiling range that the bottoms fraction; hydrotreating the first plurality of liquid products under effective hydrotreating conditions to form a first plurality of hydrotreated effluents; fractionating the hydrotreated effluent to form a first plurality of liquid products, the first plurality of liquid fraction including a first lubricant boiling range fraction; hydrocracking at least a portion of the first lubricant base oil boiling range fraction under effective hydrocracking conditions; exposing at least a portion of the bottoms fraction to a catalyst under effective slurry hydroconversion conditions to form at least a second plurality of liquid product including at least a second lubricant boiling range fraction, the effective slurry hydroconversion conditions being effective for conversion of at least about 90 wt % of the bottoms fraction relative to a conversion temperature; and hydrocracking at least a portion of the second lubricant base oil boiling range fraction.

Embodiment 17

The method of Embodiment 16, wherein the separated bottoms fraction has a 10% distillation point of at least about 1000° F.

Embodiment 18

The method of any of Embodiments 16 or 17, further comprising dewaxing at least a portion of the hydrocracked first lubricant boiling range fraction, the hydrocracked second lubricant boiling range fraction, or a combination thereof.

Embodiment 19

The method of any of Embodiments 16 to 18, further comprising hydrofinishing at least a portion of the hydrocracked first lubricant boiling range fraction, the hydrocracked second lubricant boiling range fraction, or a combination thereof.

Embodiment 20

The method of any of Embodiments 16 to 19, wherein the heavy oil has a Conradson carbon residue of at least about 27.5 wt %, optionally at least about 30 wt %.

Embodiment 21

The method of any of Embodiments 16 to 20, wherein exposing the heavy oil feedstock to a catalyst under effective slurry hydroconversion conditions further comprises forming an unconverted slurry hydroconversion pitch.

Embodiment 22

The method of any of Embodiments 16 to 21, wherein hydrocracking at least a portion of the first lubricant base oil boiling range fraction under effective hydrocracking conditions comprises exposing the at least a portion of the first lubricant base oil boiling range fraction to a molecular sieve selected from USY, ZSM-48, or a combination thereof.

Embodiment 23

The method of any of Embodiments 16 to 22, wherein hydrocracking at least a portion of the second lubricant base oil boiling range fraction under effective hydrocracking conditions comprises exposing the at least a portion of the second lubricant base oil boiling range fraction to a molecular sieve selected from USY, ZSM-48, or a combination thereof.

Embodiment 24

The method of any of the above embodiments, wherein the effective hydrotreating conditions, the second effective hydrotreating conditions, or both comprise temperatures of 200° C. to 450° C., or 315° C. to 425° C.; pressures of 250 psig (1.8 MPag) to 5000 psig (34.6 MPag) or 300 psig (2.1 MPag) to 3000 psig (20.8 MPag); liquid hourly space velocities (LHSV) of 0.1 $hr^{-1}$ to 10 $hr^{-1}$; and hydrogen treat rates of 200 scf/B (35.6 $m^3/m^3$) to 10,000 scf/B (1781 $m^3/m^3$), or 500 (89 $m^3/m^3$) to 10,000 scf/B (1781 $m^3/m^3$).

Embodiment 25

The method of any of the above embodiments, wherein the effective hydrocracking conditions, the second effective hydrocracking conditions, or both comprise temperatures of about 550° F. (288° C.) to about 840° F. (449° C.), hydrogen partial pressures of from about 250 psig to about 5000 psig (1.8 MPag to 34.6 MPag), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCF/B), and optionally comprise a temperature of about 600° F. (343° C.) to about 815° F. (435° C.), hydrogen partial pressures of from about 500 psig to about 3000 psig (3.5 MPag-20.9 MPag), and hydrogen treat gas rates of from about 213 $m^3/m^3$ to about 1068 $m^3/m^3$ (1200 SCF/B to 6000 SCF/B).

Embodiment 26

The method of any of Embodiments 4-15 or 18-25, wherein the effective dewaxing conditions, the second effective dewaxing conditions, or both comprise temperatures of from 200 to 450° C., optionally 270 to 400° C., optionally about 343° C. to about 435° C.; hydrogen partial pressures of from 1.8 MPag to 34.6 MPag (250 psig to 5000 psig), optionally 4.8 MPag to 20.8 MPag, optionally 3.5 MPag to 20.9 MPag; hydrogen treat gas rates of from 35.6 $m^3/m^3$ (200 SCF/B) to 1781 $m^3/m^3$ (10,000 scf/B), optionally 178 $m^3/m^3$ (1000 SCF/B) to 890.6 $m^3/m^3$ (5000 SCF/B), optionally about 213 $m^3/m^3$ to about 1068 $m^3/m^3$; and liquid hourly space velocities of about 0.2 $h^{-1}$ to about 10 $h^{-1}$, optionally about 0.5 $h^{-1}$ to about 5 $h^{-1}$, optionally about 1 $h^{-1}$ to about 4 $h^{-1}$.

Embodiment 27

The method of any of Embodiments 5-15 or 19-25, wherein the effective hydrofinishing conditions, the second effective hydrofinshing conditions, or both comprise temperatures from about 125° C. to about 425° C., optionally about 180° C. to about 280° C.; hydrogen partial pressures from about 500 psig (3.4 MPa) to about 3000 psig (20.7 MPa), optionally about 1500 psig (10.3 MPa) to about 2500 psig (17.2 MPa); liquid hourly space velocities from about 0.1 $hr^{-1}$ to about 5 $hr^{-1}$ LHSV, optionally about 0.5 $hr^{-1}$ to about 1.5 $hr^{-1}$; and hydrogen treat gas rates of from 35.6 $m^3/m^3$ to 1781 $m^3/m^3$ (200 SCF/B to 10,000 SCF/B).

Embodiment 28

The method of any of Embodiments 8-15, wherein the effective distillate fuel dewaxing conditions comprise temperatures of about 500° F. (260° C.) to about 750° F. (399° C.); pressures of about 200 psig (1.4 MPa) to about 1500 psig (10.3 MPa); liquid hourly space velocities of about 0.5 $hr^{-1}$ to about 5.0 $hr^{-1}$; and treat gas rates of about 500 scf/bbl (84 $m^3/m^3$) to about 4000 scf/bbl (674 $m^3/m^3$).

What is claimed is:

1. A method for processing a heavy oil feedstock, comprising:

providing a heavy oil feedstock having a 5 wt % boiling point of at least about 650° F. (343° C.) and a first Conradson carbon residue wt %;

exposing the heavy oil feedstock to a catalyst under effective slurry hydroconversion conditions to form at least a first liquid product, the effective slurry hydroconversion conditions being effective for conversion of at least about 90 wt % of the heavy oil feedstock relative to a conversion temperature;

hydrotreating the first liquid product under effective hydrotreating conditions to form a first hydrotreated liquid product;

fractionating the first hydrotreated liquid product to form one or more naphtha boiling range products, one or more distillate fuel boiling range products, and one or more lubricating base oil boiling range products; and hydrocracking at least a portion of the one or more lubricating base oil boiling range products to form at least one hydrocracked fuel product and a hydrocracking bottoms product.

2. The method of claim 1, further comprising recycling at least a portion of the hydrocracking bottoms product, the hydrocracking of the at least a portion of the one or more lubricating base oil boiling range products further comprising hydrocracking the hydrocracking bottoms product.

3. The method of claim 1, further comprising dewaxing at least a portion of the hydrocracking bottoms product.

4. The method of claim 3, further comprising hydrofinishing at least a portion of the hydrocracking bottoms product.

5. The method of claim 1, wherein the heavy oil feedstock has a 10% distillation point of at least about 900° F. (482° C.), a Conradson carbon residue of at least about 27.5 wt %, or a combination thereof.

6. The method of claim 1, wherein exposing the heavy oil feedstock to a catalyst under effective slurry hydroconversion conditions further comprises forming an unconverted slurry hydroconversion pitch.

7. The method of claim 1, wherein the hydrocracking catalyst comprises a molecular sieve selected from USY, ZSM-48, or a combination thereof.

8. The method of claim 1, further comprising dewaxing a portion of at least one of the one or more distillate fuel products under effective distillate fuel dewaxing conditions.

9. The method of claim 1, wherein exposing the heavy oil feedstock to a catalyst under effective slurry hydroconversion conditions to form at least a first liquid product comprises:

exposing the heavy oil feedstock to a first catalyst under first effective slurry hydroconversion conditions to form a first slurry hydroconversion effluent; and exposing at least a portion of the first slurry hydroconversion effluent to a second catalyst under second effective slurry hydroconversion conditions to form a second slurry hydroconversion effluent, the first liquid product comprising at least a portion of the second slurry hydroconversion effluent.

10. The method of claim 9, wherein a temperature of the second effective slurry hydroconversion conditions is greater than a temperature of the first effective slurry hydroconversion conditions by about 10° C. to about 80° C.

11. The method of claim 9, further comprising fractionating the first slurry hydroconversion effluent to form at least one of a naphtha fraction or a distillate fuel fraction, and at least one slurry resid or bottoms fraction, the slurry resid or bottoms fraction containing a portion of the first catalyst corresponding to at least about 50% of the first catalyst in the first slurry hydroconversion effluent, wherein exposing at least a portion of the first slurry hydroconversion effluent to the second catalyst comprises exposing at least a portion of the slurry resid or bottoms fraction to the second catalyst.

12. The method of claim 11, wherein the second catalyst comprises the portion of the first catalyst contained in the slurry resid or bottoms fraction.

13. The method of claim 11, further comprising separating the slurry resid or bottoms fraction to form a first catalyst fraction and a catalyst-depleted resid or bottoms fraction, the catalyst-depleted resid or bottoms fraction containing about 25 wt % or less of the catalyst in the slurry resid or bottoms fraction prior to separation, wherein exposing at least a portion of the slurry resid or bottoms fraction to the second catalyst comprises exposing at least a portion of the catalyst-depleted resid or bottoms fraction to the second catalyst.

14. The method of claim 13, further comprising introducing the second catalyst into the catalyst-depleted resid or bottoms fraction.

15. The method of claim 11, wherein the first slurry hydroconversion effluent is fractionated in a divided wall fractionator, the method further comprising fractionating the second slurry hydroconversion effluent in the divided wall fractionator.

* * * * *